US012753584B2

(12) United States Patent
Wells et al.

(10) Patent No.: US 12,753,584 B2
(45) Date of Patent: Oct. 6, 2026

(54) TOOL RETENTION SYSTEM WITH EXTERNAL LOCKING MECHANISM

(71) Applicant: CATERPILLAR INC., Peoria, IL (US)

(72) Inventors: Corey Michael Wells, East Peoria, IL (US); Eric Thomas Sinn, Tremont, IL (US); Brandon Hammig McCaffrey, St. Louis, MO (US); William Jay Ulrich, IV, East Peoria, IL (US); Douglas Charles Serrurier, Morton, IL (US)

(73) Assignee: Caterpillar Inc., Peoria, IL (US)

( * ) Notice: Subject to any disclaimer, the term of this patent is extended or adjusted under 35 U.S.C. 154(b) by 558 days.

(21) Appl. No.: 18/356,277

(22) Filed: Jul. 21, 2023

(65) Prior Publication Data

US 2025/0027298 A1 Jan. 23, 2025

(51) Int. Cl.
*E02F 9/28* (2006.01)

(52) U.S. Cl.
CPC ..... *E02F 9/2841* (2013.01); *E02F 9/2825* (2013.01)

(58) Field of Classification Search
CPC ..... E02F 9/2841; E02F 9/2825; E02F 9/2833; E02F 9/2858; E02F 9/2816; E02F 9/2808; E02F 9/285
See application file for complete search history.

(56) References Cited

U.S. PATENT DOCUMENTS

| | | | | | |
|---|---|---|---|---|---|
| 3,952,433 | A * | 4/1976 | Heinold | E02F 9/2841 | 24/581.1 |
| 3,997,989 | A * | 12/1976 | Stepe | F16B 21/186 | 37/459 |
| 4,848,013 | A * | 7/1989 | Bowman | E02F 9/2841 | 403/379.5 |
| 5,205,057 | A * | 4/1993 | Garman | E02F 9/2841 | 37/458 |
| 5,724,756 | A | 3/1998 | Gale | | |
| 6,092,958 | A * | 7/2000 | Gale | F16B 21/186 | 37/456 |
| 7,178,274 | B2 * | 2/2007 | Emrich | E02F 9/2841 | 37/453 |
| 7,640,684 | B2 * | 1/2010 | Adamic | E02F 9/2825 | 37/456 |
| 7,658,025 | B2 * | 2/2010 | Bentley | E02F 9/2833 | 37/456 |

(Continued)

FOREIGN PATENT DOCUMENTS

| | | | |
|---|---|---|---|
| JP | 2003027532 | A | 1/2003 |
| JP | 2011246974 | A | 12/2011 |

*Primary Examiner* — Jamie L Mcgowan

(57) ABSTRACT

A retention mechanism may have a pin inserted into a retainer pin opening in the adapter. The retention mechanism may also have a spring clip inserted into the tip through a first end of a transverse hole in the tip, and a retainer inserted through a second end of the transverse hole. The retainer may have a retainer body extending from a first axial end to a second axial end. The retainer may have at least one tab extending radially from the retainer body at the first axial end. The at least one tab may engage with a female thread in the transverse hole. The retainer may have at least one detent cutout disposed on an outer surface of the retainer body for receiving a portion of the spring clip. The retainer may also have an axial cavity at the second axial end for receiving one end of the pin.

20 Claims, 23 Drawing Sheets

(56) References Cited

U.S. PATENT DOCUMENTS

| | | | | |
|---|---|---|---|---|
| 7,762,015 | B2 * | 7/2010 | Smith | E02F 9/2858 37/455 |
| 8,495,826 | B2 * | 7/2013 | Itou | E02F 9/2875 37/456 |
| 8,925,221 | B2 * | 1/2015 | Jeske | E02F 9/2891 37/455 |
| 9,027,268 | B2 * | 5/2015 | Campomanes | E02F 9/2891 37/455 |
| 9,033,610 | B2 * | 5/2015 | Lopez Almendros | E02F 9/2841 403/348 |
| 9,074,350 | B2 * | 7/2015 | LaHood | E02F 9/2841 |
| 9,175,457 | B2 * | 11/2015 | Rimmey | E02F 9/2891 |
| 9,260,839 | B2 * | 2/2016 | Kunz | E02F 9/2833 |
| 9,476,184 | B2 * | 10/2016 | Wallis | E02F 9/2833 |
| 9,512,599 | B2 * | 12/2016 | Rol Corredor | E02F 9/2841 |
| 9,702,122 | B2 * | 7/2017 | Hurley | E02F 9/2833 |
| 9,976,287 | B2 * | 5/2018 | Kunz | E02F 9/2841 |
| 10,208,460 | B2 | 2/2019 | Almendros et al. | |
| 10,385,548 | B2 * | 8/2019 | Guimaraes | E02F 9/2816 |
| 10,563,381 | B2 * | 2/2020 | Voelz | E02F 9/2825 |
| 10,577,778 | B2 * | 3/2020 | Quarfordt | E02F 9/2841 |
| 10,907,328 | B2 * | 2/2021 | Ortiz Garcia | E02F 9/2841 |
| 11,142,894 | B2 * | 10/2021 | Wells | E02F 9/2833 |
| 11,427,991 | B2 * | 8/2022 | Ortiz Garcia | E02F 9/2858 |
| 11,661,726 | B2 * | 5/2023 | Nagata | E02F 9/2825 37/456 |
| 2002/0000053 | A1 * | 1/2002 | Adamic | E02F 9/2825 37/456 |
| 2008/0148608 | A1 * | 6/2008 | Harder | E02F 9/2858 37/455 |
| 2009/0044435 | A1 * | 2/2009 | Bentley | E02F 9/2841 37/456 |
| 2014/0259806 | A1 * | 9/2014 | Rimmey | E02F 9/2841 37/455 |
| 2014/0352182 | A1 * | 12/2014 | LaHood | E02F 9/2841 37/455 |
| 2015/0033595 | A1 * | 2/2015 | Chenoweth | E02F 9/2833 37/455 |
| 2016/0237657 | A1 * | 8/2016 | Carpenter | E02F 9/2841 |
| 2017/0328037 | A1 * | 11/2017 | Serrurier | E02F 9/2841 |
| 2018/0073220 | A1 * | 3/2018 | Voelz | E02F 9/2825 |
| 2020/0131743 | A1 * | 4/2020 | Bingham | E02F 9/2833 |
| 2020/0340219 | A1 * | 10/2020 | Wells | E02F 9/2841 |
| 2020/0378090 | A1 * | 12/2020 | Jura | E02F 9/2833 |
| 2021/0047809 | A1 * | 2/2021 | Serrurier | E02F 3/40 |
| 2022/0259836 | A1 * | 8/2022 | Jura | E02F 9/2833 |
| 2022/0333358 | A1 * | 10/2022 | Wood | E02F 9/285 |
| 2022/0403628 | A1 * | 12/2022 | Wells | E02F 9/2833 |

* cited by examiner

TOOL RETENTION SYSTEM WITH EXTERNAL LOCKING MECHANISM

TECHNICAL FIELD

The present disclosure relates generally to retainer systems for ground engaging tools and, more particularly, to retainer systems for removably attaching tooth assemblies with replaceable tip and adapter systems to a ground engaging implement of an earth-working machine.

BACKGROUND

Earth-working machines, for example, excavators, wheel loaders, hydraulic mining shovels, cable shovels, bucket wheels, bulldozers, and draglines are generally used for digging or ripping into the earth or rock and/or for moving loosened work material from one place to another on a worksite. Such earth-working machines typically include earth-working implements, such as a bucket or a blade, for excavating or moving the work material. These earth-working implements are subjected to extreme wear due to abrasion caused by or impacts of the work material on the implements.

To facilitate the earth-moving process and to prolong the useful life of the implement, a plurality of tip assemblies may be placed along a base edge of a working implement (e.g., bucket or blade) and may be attached to a surface of the implement. The tip assemblies project forward from the base edge and form a first point of contact with and penetration into the work material. Thus the abrasion and impacts caused by the work material tend to cause wear on the tip assemblies instead of on the base edge, reducing the amount of wear on the base edge. With this arrangement, the tip assemblies may be subjected to the wear and/or breakage caused by repetitive engagement with the work material. Periodically, the tip assemblies must be replaced, but the implement may remain useable through multiple cycles of replacement tip assemblies. Depending on the variety of uses and work materials for the equipment, it may also be desirable to change the type and/or shape of the tip assemblies to most effectively utilize the implement.

Installation and replacement of the tip assemblies may be facilitated by providing the tip assemblies with a variety of retention systems. For example, an adapter may be attached to the base edge of the implement. The adapter may be welded, bolted, or otherwise secured to the base edge. A ground engaging tip may be attached to the adapter using a retention mechanism that facilitates installation and/or removal of the tip to/from the adapter.

U.S. Pat. No. 8,495,826 of Itou et al. issued on Jul. 30, 2013 ("the '826 patent") and discloses a ground engaging tool and an adapter, each with through holes. The retention mechanism of the '826 patent includes bushings inserted into the through holes of the ground engaging tools and a pin inserted into the through holes of the ground engaging tool and adapter through the bushings. The retention mechanism of the '826 patent further includes bolts that are inserted through washers and then threaded into a threaded hole in each of the pins.

Although the '826 patent discloses a retention mechanism for a ground engaging tool assembly that allows for installation and removal, the disclosed assembly requires the use of several components such as washers and bolts that may be easily misplaced on a work site. Further, use of a threaded connection as disclosed in the '826 patent may require precise manufacturing tolerances that may make increase a manufacturing cost of the components. Additionally, it may be difficult to ensure that the bolts of the retention mechanism disclosed by the '826 patent are sufficiently tightened to provide adequate support to the ground engaging tool.

The system and method of the present disclosure solves one or more of the problems set forth above and/or other problems of the prior art.

SUMMARY

In one aspect, the present disclosure is directed to a retention mechanism for connecting a ground engaging tip to an adapter. The retention mechanism may include a pin configured to be inserted into a retainer pin opening in the adapter. The retention mechanism may also include a spring clip configured to be inserted into the tip through a first end of a transverse hole in the tip. Further the retention mechanism may include a retainer configured for insertion through a second end of the transverse hole. The retainer may include a retainer body extending from a first axial end to a second axial end. The retainer may also include at least one tab extending radially from the retainer body at the first axial end. The at least one tab may be configured to engage with a female thread in the transverse hole. The retainer may include at least one detent cutout disposed on an outer surface of the retainer body and configured to receive a portion of the spring clip. The retainer may also include an axial cavity at the second axial end configured to receive one end of the pin.

In another aspect, the present disclosure is directed to a tip assembly. The tip assembly may include an adapter configured to be attached to a work implement. The adapter may include a nose, and a retainer pin opening extending through the nose. The tip assembly may include a ground engaging tip configured to be attached to the nose. The tip may include a nose cavity configured to receive the nose. The nose cavity may include a pair of side walls spaced apart from each other. The tip may include a first transverse hole disposed in a first one of the side walls, and a second transverse hole disposed in a second one of the side walls. The tip assembly may also include a retention mechanism. The retention mechanism may include a pin configured to be inserted into the retainer pin opening in the nose. The retention mechanism may include a first spring clip configured to be inserted into the first transverse hole, and a second spring clip configured to be inserted into the second transverse hole. Further, the retention mechanism may include a first retainer configured for insertion into the first transverse hole. The first retainer may be configured to engage with the pin. The retention mechanism may also include a second retainer configured for insertion into the second transverse hole. The second retainer may be configured to engage with the pin.

In another aspect, the present disclosure is directed to a retention mechanism. The retention mechanism may include a pin, a retainer, and a spring clip. The retainer may include a retainer body extending from a first axial end to a second axial end. The retainer may also include at least one tab extending radially from the retainer body at the first axial end. Further, the retainer may include at least one detent cutout disposed on an outer surface of the retainer body. The retainer may include an axial cavity at the second axial end configured to receive one end of the pin. The spring clip may include at least one leg. The spring clip may further include a base portion extending perpendicularly from one edge of the at least one leg. The spring clip may include a pair of flexible arms extending from opposite ends of the base portion and configured to engage with an outer surface of the retainer body. The spring clip may also include a detent portion attached to a distal end of each of the flexible arms, wherein the detent portion is configured to engage with the at least one detent cutout of the retainer.

DETAILED DESCRIPTION

Figure 1:
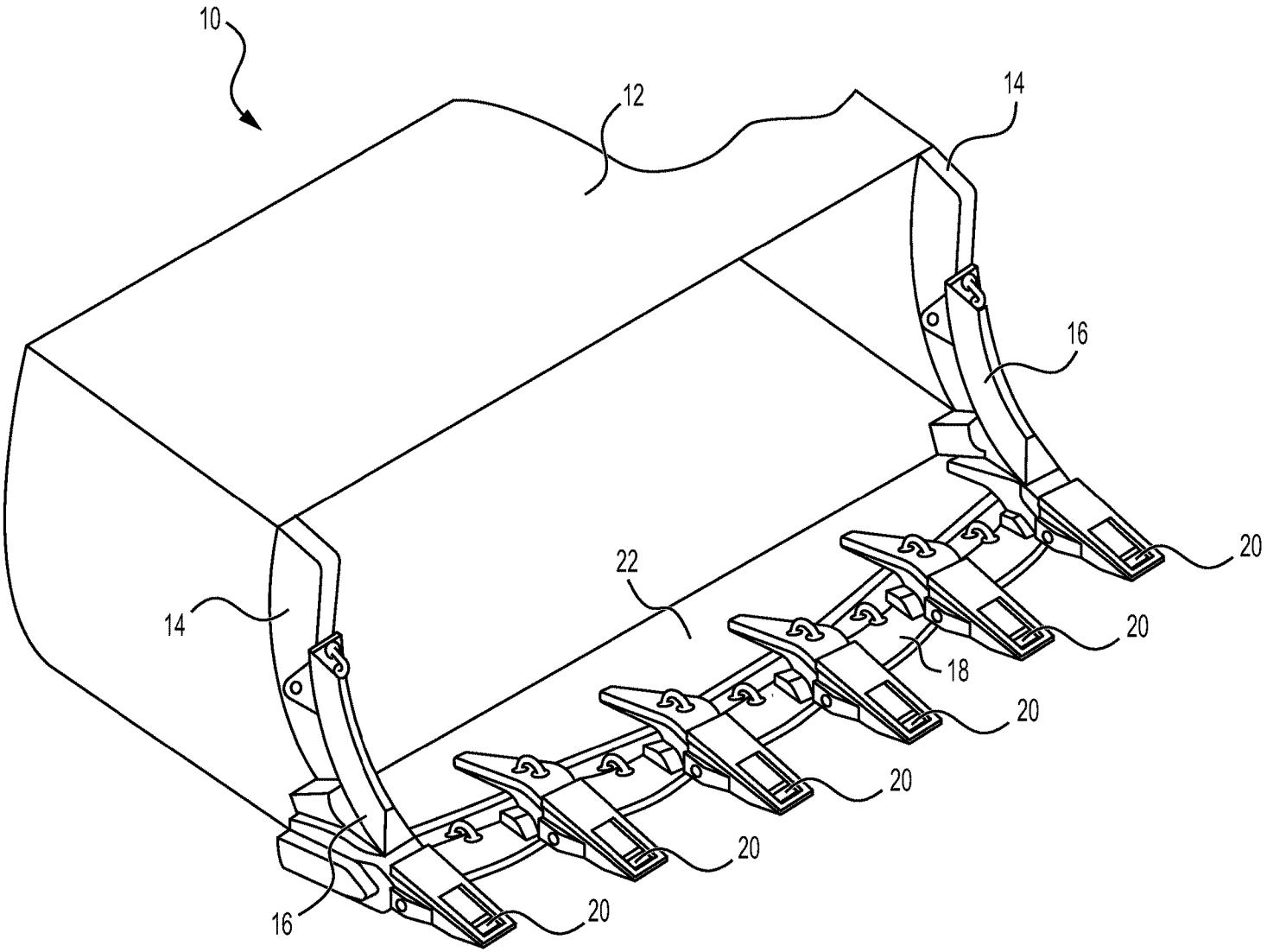
FIG. 1 is a pictorial illustration of an exemplary working implement.

FIG. 1 illustrates an exemplary work implement 10 for a bottom wearing application, such as a loader machine application. As illustrated in the exemplary embodiment of FIG. 1, the work implement 10 may be a bucket 12, which may include a pair of oppositely-disposed arms 14 on which corresponding corner guards 16 may be mounted. Bucket 12 may also include a plurality of ground-engaging tip assemblies 20 mounted along a base edge 22 with edge protector assemblies 18 interposed between the tip assemblies 20 and secured along the base edge 22 of the bucket 12.

Figure 2:
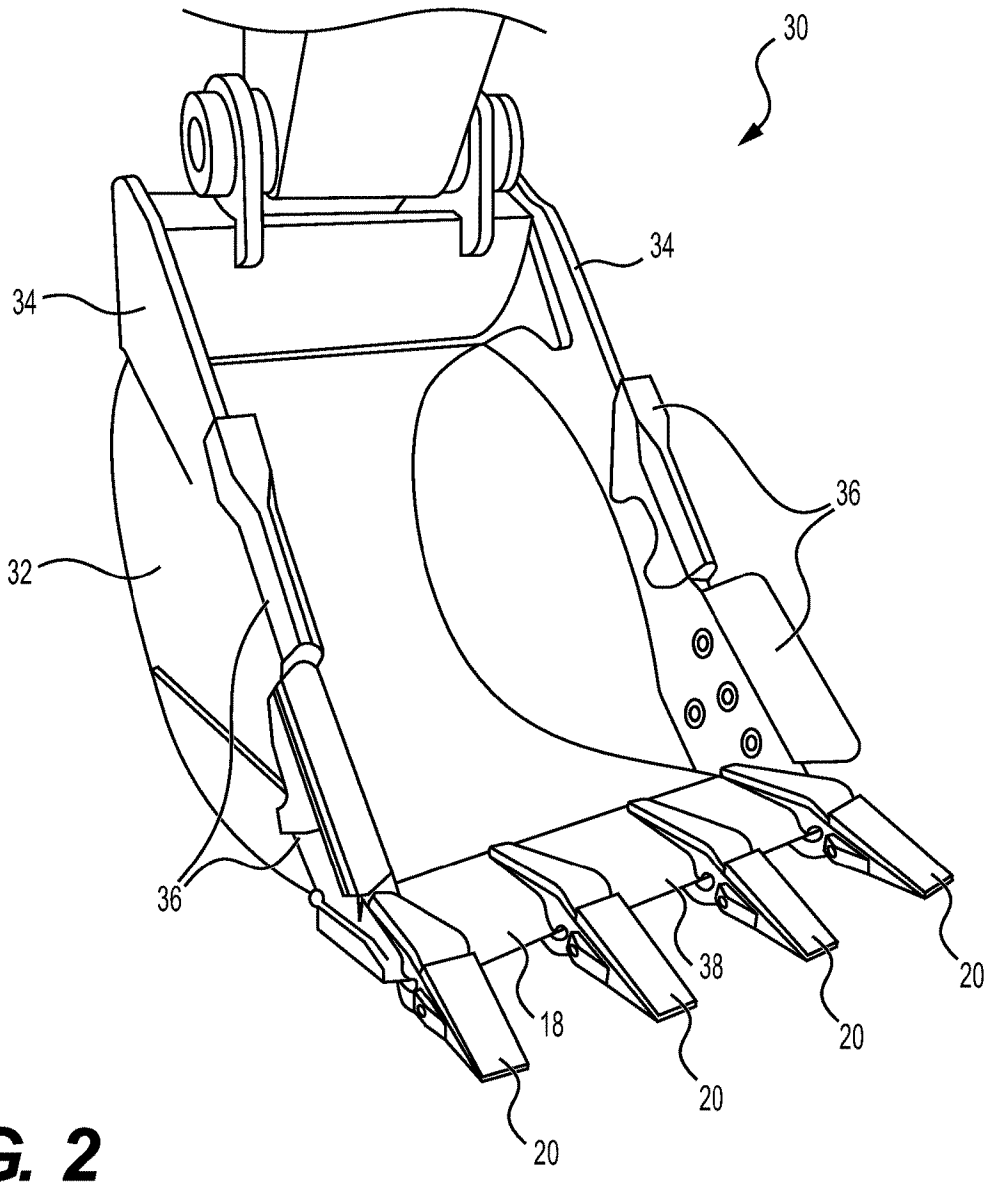
FIG. 2 is a pictorial illustration of another exemplary working implement.

FIG. 2 illustrates another exemplary work implement 30 for a top-wearing application, such as an excavator application. As illustrated in the exemplary embodiment of FIG. 2, work implement 30 may take the form of an excavator bucket 32. Bucket 32 may include a pair of oppositely-disposed arms 34 on which corresponding corner guards 36 may be mounted. Bucket 32 may include a plurality of tip assemblies 20 mounted along a base edge 38. Work implement 30 may also include one or more edge protector assemblies 18 interposed between tip assemblies 20, with edge protector assemblies 18 and tip assemblies 20 being secured along base edge 38 of the bucket 32. Although exemplary work implements 10 and 30 have been illustrated in FIGS. 1 and 2, it is contemplated that work implements of other shapes and sizes may also include tip assemblies 20 attached respective base edges of the work implements.

Various embodiments of tip assemblies may be implemented in bottom wearing or top wearing applications. Although a particular tip assembly or component embodiment may be described with respect to a particular bottom wearing or top wearing application, it is to be understood that the tip assemblies are not limited to a particular type of application and may be interchangeable between implements of various applications. Further, although bottom wearing and top wearing applications have been described above, it is to be understood that the disclosed embodiments are not limited to the described applications. Rather, the disclosed embodiments may be used on implements used in other types of applications (e.g., front wearing applications, end-wearing applications, or any other applications for which such implements may be used).

Figure 3:
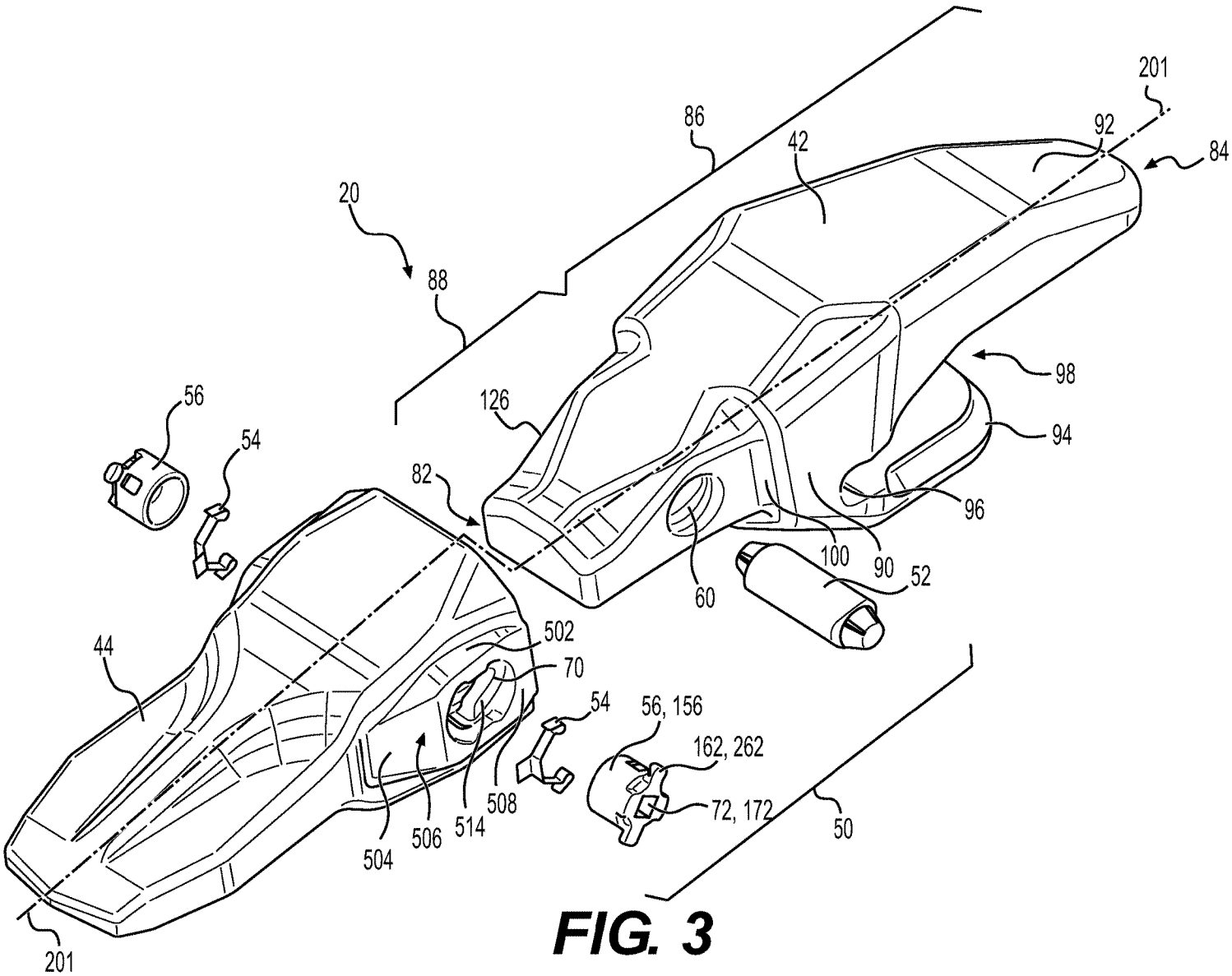
FIG. 3 is an exploded perspective view of an exemplary tip assembly for the buckets of FIGS. 1 and 2.

FIG. 3 is an exploded view illustrating components of an exemplary tip assembly 20. Tip assembly 20 may be used on multiple types of ground engaging implements that have a base edge, such as base edge 22 or 38 (see FIGS. 1-2). Tip assembly 20 may include an adapter 42 configured for attachment to a base edge, such as the base edge 22 or 38 of the implement 10 or 30, respectively, and a ground engaging tip 44 configured for attachment to the adapter 42. The tip assembly 20 may further include a retention mechanism 50 for securing the ground engaging tip 44 to the adapter 42. The retention mechanism 50 may comprise a pin 52, one or more spring clips 54, and one or more retainers 56. Adapter 42 may include retainer pin opening 60 configured to receive pin 52. Tip 44 may include one or more transverse holes 70 (one transverse hole 70 shown in FIG. 3). Spring clip 54 and retainer 56 may be insertable into each transverse hole 70 of tip 44. Once attached to adapter 42, tip 44 may extend outwardly from base edge 22 or 38 of work implement 10 or 30, respectively, for initial engagement with work material.

Adapter 42 may extend from adapter front end 82 to adapter rear end 84. Adapter 42 may include adapter rear portion 86 and nose 88. Adapter rear portion 86 may include strap wall 90, upper strap 92 and lower strap 94. In some exemplary embodiments, upper strap 92 may be disposed at a position higher than lower strap 94 relative to a direction of gravity. It is contemplated however that in some embodiments upper strap 92 may be disposed at a position lower than lower strap 94. Accordingly, the terms upper and lower should be understood as merely defining positions relative to each other and not necessarily relative to a direction of gravity. Upper strap 92 may extend from the rear face 96 of strap wall 90 in a direction from adapter front end 82 towards adapter rear end 84. Similarly lower strap 94 may extend from the rear face 96 of strap wall 90 in a direction from adapter front end 82 towards adapter rear end 84. Upper strap 92 and lower strap 94 may have the same or different lengths, weights, and/or shapes. Upper strap 92 and lower strap 94 may be spaced apart from each other by gap 98 that may be configured to receive base edge 22 or 38 of work implement 10 or 30, respectively. Base edge 22 or 38 of work implement 10 or 30, respectively, when inserted into gap 98 may abut against rear face 96 of strap wall 90. Adapter 42 may be attached to base edge 22 or 38 of work implement 10 or 30, respectively, using fasteners, such as, bolts, nuts, screws, rivets, and/or using welding, brazing, or any other method of attachment.

Figure 5:
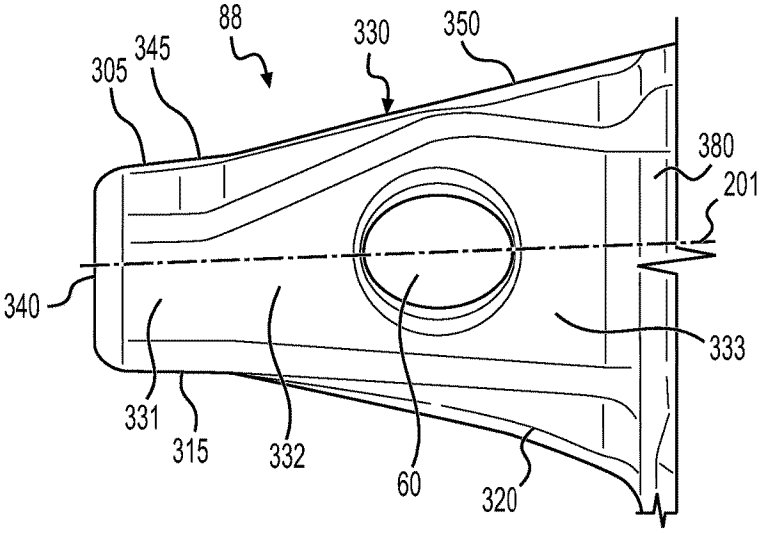
FIG. 5 is a side view of the exemplary nose of FIG. 4.
Figure 4:
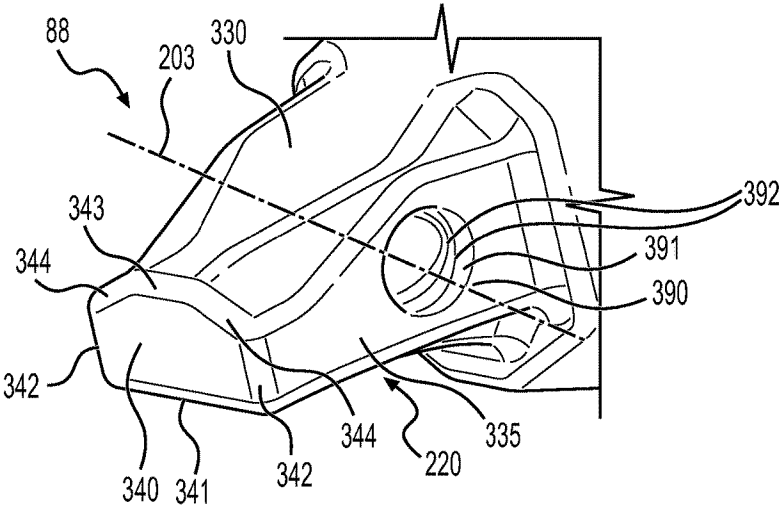
FIG. 4 is a pictorial illustration of an exemplary nose of an adapter for the tip assembly of FIG. 3.
Figure 6:
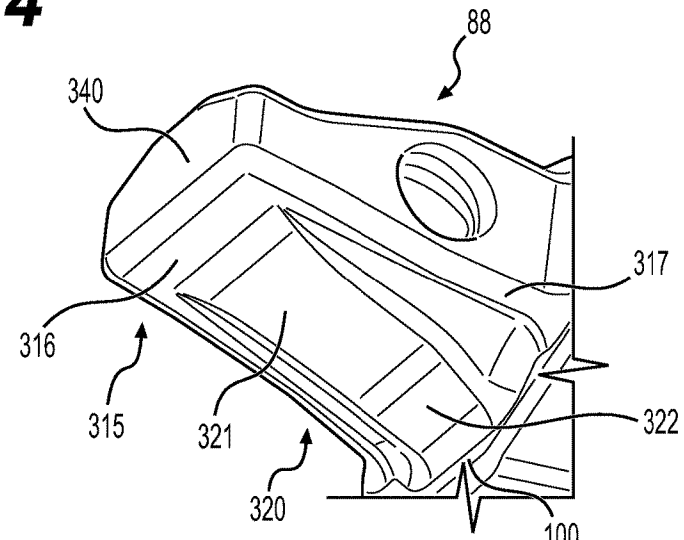
FIG. 6 is another pictorial illustration of the exemplary nose of FIG. 4.

FIGS. 4-6 depict various views of the nose 88 of adapter 42 (see FIG. 3) As depicted in FIGS. 4-6, nose 88 of adapter 42 may be an asymmetrical nose having a bottom surface 315 and a top surface 330 differently shaped from the bottom surface 315. Nose 88 may also include opposing side surfaces 335, a front surface 340, and a rear edge 380 that may abut on a front face 100 (see FIG. 3) of strap wall 90 (see FIG. 3). The rear edge 380 may coincide with a plane disposed generally perpendicular to the longitudinal axis 201 (see FIG. 3) and intersecting with the adapter 42 at a location at which the adapter 42 has its largest cross-sectional area (e.g., at front face 100 of strap wall 90). Rear edge 380 may abut on front face 100 of strap wall 90.

The bottom surface 315 may comprise a generally planar front portion 316 disposed proximate to and extending rearwardly (e.g., in a direction from adapter front end 82 toward adapter rear end 84 of FIG. 3) from the front surface 340, and a rear portion 317 extending rearwardly from the front portion 316 toward the rear edge 380 of nose 88. The bottom surface 315 may provide a stable surface to act as a contact area when the tip 44 is subjected to an upward load, while reducing wear on the tip assembly 20 (see FIGS. 1-3). The top surface 330 of nose 88 may be configured to support the ground engaging tip 44 (see FIG. 3) during use of the implement 10 or 30 (see FIGS. 1-2) and to facilitate retention of the ground engaging tip 44 on the nose 88 when bearing a load of work material. The top surface 330 may include a plurality of surfaces as explained below.

As depicted in FIG. 5, the nose 88 may include surfaces such as a generally planar front-side surface 305 disposed proximate to the front surface 340, a generally planar intermediate-side surface 345 extending rearwardly (e.g., in a direction from adapter front end 82 towards adapter rear end 84 of FIG. 3) from the front-side surface 305, and a rear-side surface 350 extending rearwardly from the intermediate-side surface 345 to the rear edge 380 of the nose 88. The front surface 340 of the nose 88 may be planar as shown in FIGS. 4-6. In other embodiments (not shown), it may include a degree of curvature. As depicted in FIG. 4, front surface 340 may be hexagonally shaped comprising a bottom edge 341, opposing side edges 342 oriented at about 90° with respect to the bottom edge 341, a top horizontal edge 343 oriented about parallel to the bottom edge 341, and opposing top sloping edges 344 connecting the top horizontal edge 343 to the side edges 342. It is contemplated, however, that in some exemplary embodiments, front surface 340 may have a triangular, square, rectangular, circular, elliptical, polygonal, or any other shape.

As depicted in FIG. 6, nose 88 may also include a bottom rib 320 of the bottom surface 315. The bottom rib 320 of the bottom surface 315 may comprise a generally planar front rib portion 321 inclined downwardly (e.g., in a direction from top surface 330 towards bottom surface 315) relative to the bottom surface 315, and a generally planar rear rib portion 322 inclined downwardly relative to the front rib portion 321, between opposing rib side surfaces. The bottom rib 320 may provide increased stability during side loading and increased wedging during push-on loading.

The side surfaces 335 of nose 88 may be generally planar and extend between the bottom surface 315 and the top surface 330. As depicted in FIG. 5, the side surfaces 335 (see FIG. 4) may comprise a generally planar front side surface 331 disposed proximate to the front surface 340, a generally planar intermediate side surface 332 extending rearwardly from the front side surface 331, and a rear side surface 333 extending rearwardly from the intermediate side surface 332 to the rear edge 380 of the nose 88.

Side surfaces 335 may include a retainer pin opening 60. A central axis 203 (see FIG. 4) of the retainer pin opening 60 may extend substantially perpendicular to the longitudinal axis 201 (see FIGS. 3 and 5) of the adapter 42. Retainer pin opening 60 may be designed to receive pin 52 (see FIG. 27). Retainer pin opening 60 may form a thru-hole extending from one of the side surfaces 335 to an opposite side surfaces 335. As shown in FIGS. 4-6, retainer pin opening 60 may function with the retention mechanism 50 for maintaining the connection between the ground engaging tip 44 and the adapter 42. (see FIG. 3). Retainer pin opening 60 may comprise outer angled surfaces 390, inner side surfaces 391, and inner rounded surfaces 392, as depicted in FIG. 4. Referring to outer angled surfaces 390, these surfaces may provide an angled connection (such as a bevel) between side surface 335 and inner side surfaces 391 of retainer pin opening 60. Outer angled surfaces 390 may extend around an outer perimeter of inner side surfaces 391 of retainer pin opening 60. Outer angled surfaces 390 may further comprise a partially or fully rounded connection between the inner side surfaces 391 and side surface 335. Retainer pin opening 60 may further comprise inner side surfaces 391, as depicted in FIG. 4. An outer surface 160 of retainer 56 may be spaced apart from inner side surfaces 391 (see FIG. 35). Inner side surfaces 391 may be located between outer angled surfaces 390 and inner rounded surfaces 392. Inner side surfaces 391 may define a perimeter of retainer pin opening 60 into which retainer 56 may be inserted.

Figure 7:
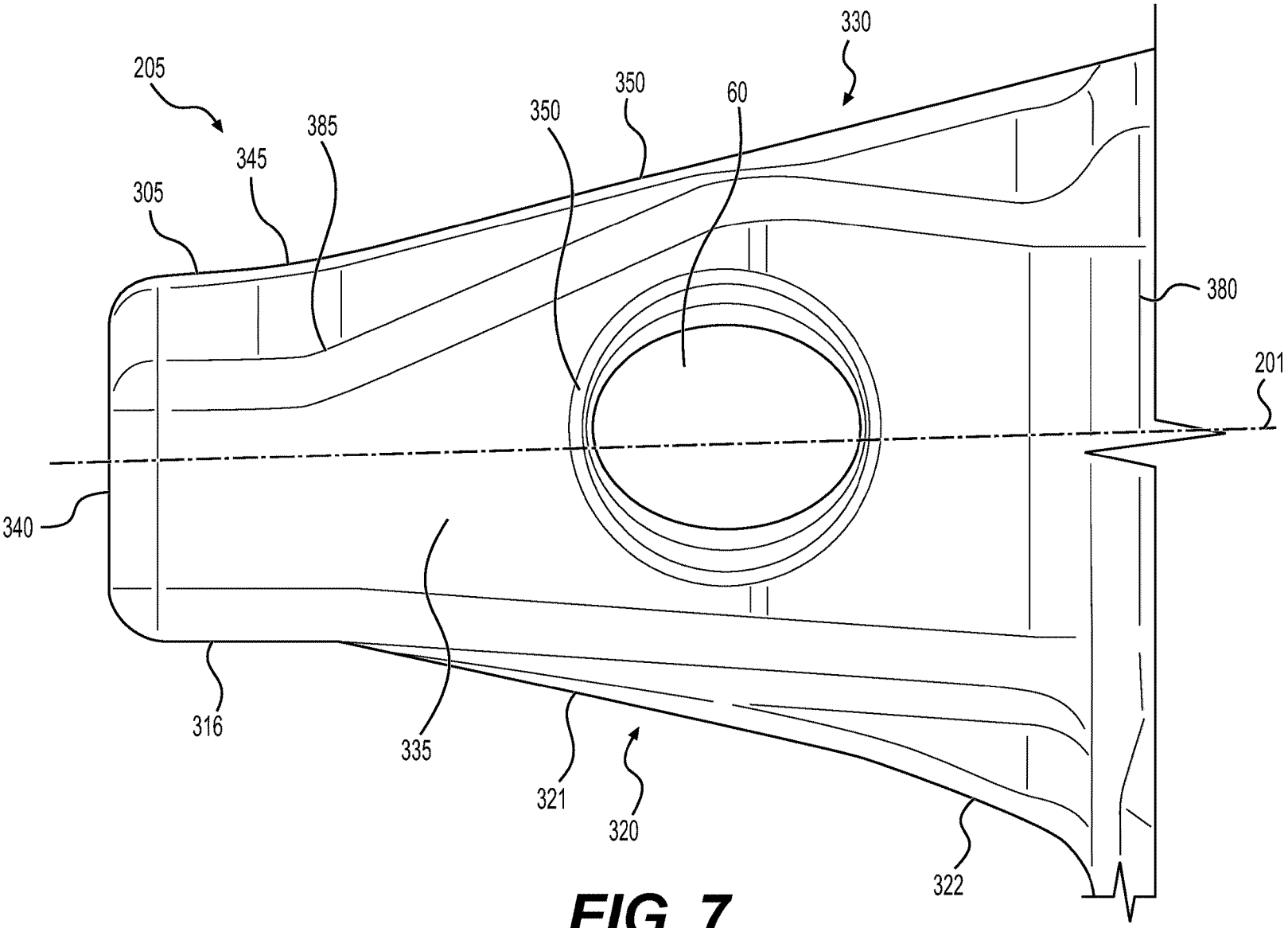
FIG. 7 is a side view of the exemplary nose of FIG. 4.

In some exemplary embodiments as depicted in FIG. 7, retainer pin opening 60 may have a generally elliptical shape with a major axis of retainer pin opening 60 being generally parallel to longitudinal axis 201. A minor axis of retainer pin opening 60 may be disposed generally perpendicular to longitudinal axis 201. Although retainer pin opening 60 has been illustrated in FIG. 7 as having an elliptical shape, it is contemplated that in some exemplary embodiments, retainer pin opening 60 may have a generally circular shape. It is further contemplated that in some exemplary embodiments, retainer pin opening 60 may have a square, rectangular, triangular, polygonal, or any other type of shape.

Figure 9:
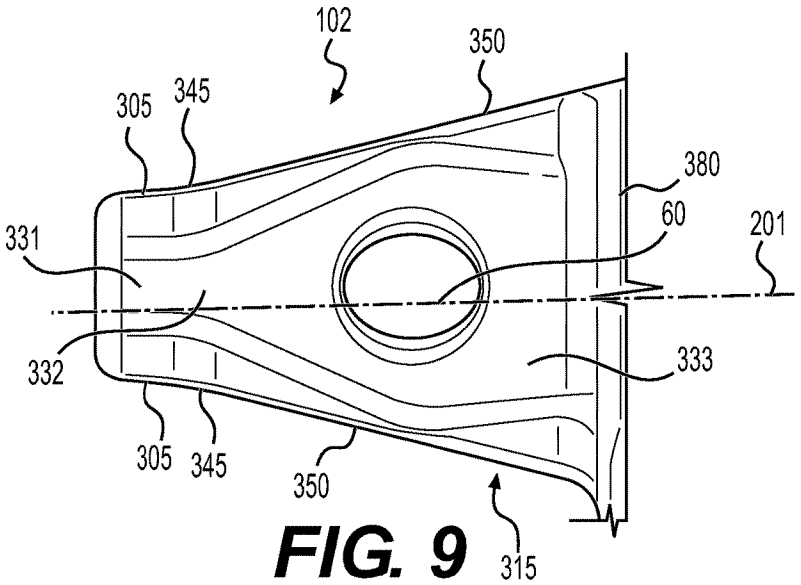
FIG. 9 is a side view of the exemplary nose of FIG. 8.
Figure 8:
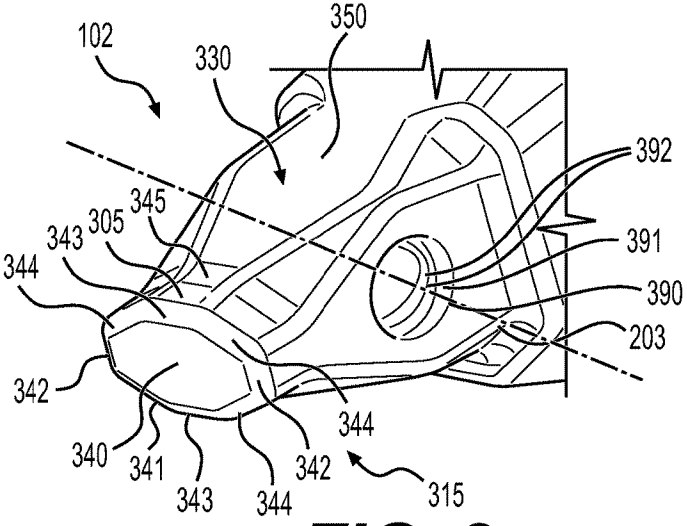
FIG. 8 is a pictorial illustration of another exemplary nose of an adapter for the tip assembly of FIG. 3.
Figure 10:
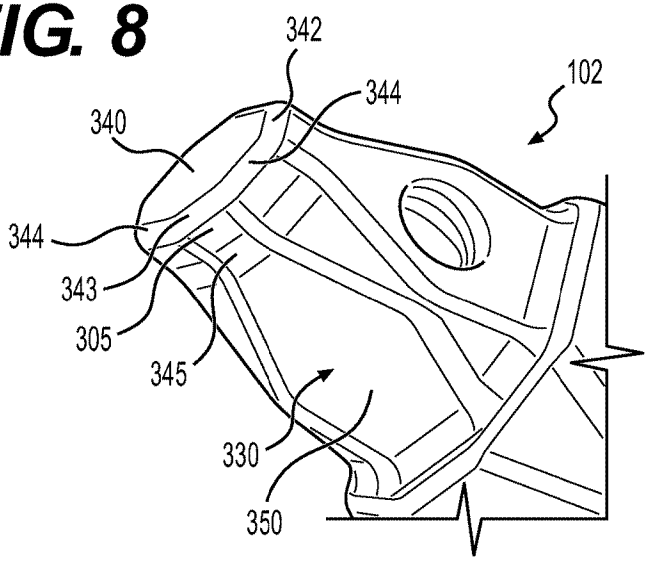
FIG. 10 is another pictorial illustration of the exemplary nose of FIG. 8.

Although nose 88 has been described above as an asymmetrical nose because top surface 330 includes features different from lower surface 315, it is contemplated that in some exemplary embodiments, adapter 42 may have a symmetrical nose that may take the place of nose 88 of FIG. 3. FIGS. 8-10 depict various views of a symmetrical nose 102 of adapter 42 (see FIG. 3) As depicted in FIGS. 8-10, nose 102 of adapter 42 may be a symmetrical nose having a bottom surface 315 that may be similarly shaped as a top surface 330, opposing side surfaces 335, a front surface 340, and a rear edge 380 that may abut on a front face 100 (see FIG. 3) of strap wall 90 (see FIG. 3). The rear edge 380 may coincide with a plane disposed generally perpendicular to the longitudinal axis 201 (see FIG. 3) and intersecting with the adapter 42 at a location at which the adapter 42 has its largest cross-sectional area (e.g., at front face 100 of strap wall 90). Rear edge 380 may abut on front face 100 of strap wall 90.

As depicted in FIG. 9, top surface 330 of the nose 102 may include surfaces such as a generally planar front-side surface 305 disposed proximate to the front surface 340, a generally planar intermediate-side surface 345 extending rearwardly (e.g., in a direction from adapter front end 82 towards adapter rear end 84 of FIG. 3) from the front-side surface 305, and a rear-side surface 350 extending rearwardly from the intermediate-side surface 345 to the rear edge 380 of the nose 102. Like the top surface 330, the bottom surface 315 of nose 102 may also comprise a generally planar front-side surface 305 disposed proximate to the front surface 340, a generally planar intermediate-side surface 345 extending rearwardly (e.g., in a direction from adapter front end 82 towards adapter rear end 84 of FIG. 3) from the front-side surface 305, and a rear-side surface 350 extending rearwardly from the intermediate-side surface 345 to the rear edge 380 of the nose 102.

The front surface 340 of the nose 102 may be planar as shown in FIGS. 8-10. In other embodiments (not shown), it may include a degree of curvature. As depicted in FIG. 8, front surface 340 may be octagonally shaped comprising opposing top and bottom edges 341, opposing side edges 342 oriented at about 90° with respect to opposing top and bottom edges 341, a top horizontal edge 343 oriented about parallel to the bottom edge 343, opposing sloping edges 344 connecting the top horizontal edge 343 to the side edges 342, and opposing sloping edges 344 connecting the bottom horizontal edge 343 to the side edges 342. It is contemplated, however, that in some exemplary embodiments, front surface 340 of symmetrical nose 102 may have a square, rectangular, circular, elliptical, polygonal, or any other shape.

The side surfaces 335 of nose 102 may be generally planar and extend between the bottom surface 315 and the top surface 330. As depicted in FIG. 9, the side surfaces 335 (see FIG. 8) may comprise a generally planar front side surface 331 disposed proximate to the front surface 340, a generally planar intermediate side surface 332 extending rearwardly from the front side surface 331, and a rear side surface 333 extending rearwardly from the intermediate side surface 332 to the rear edge 380 of the nose 102. Side surfaces 335 of nose 102 may include a retainer pin opening 60 that may be similar to the retainer pin opening 60 described above in connection with nose 88.

Figure 11:
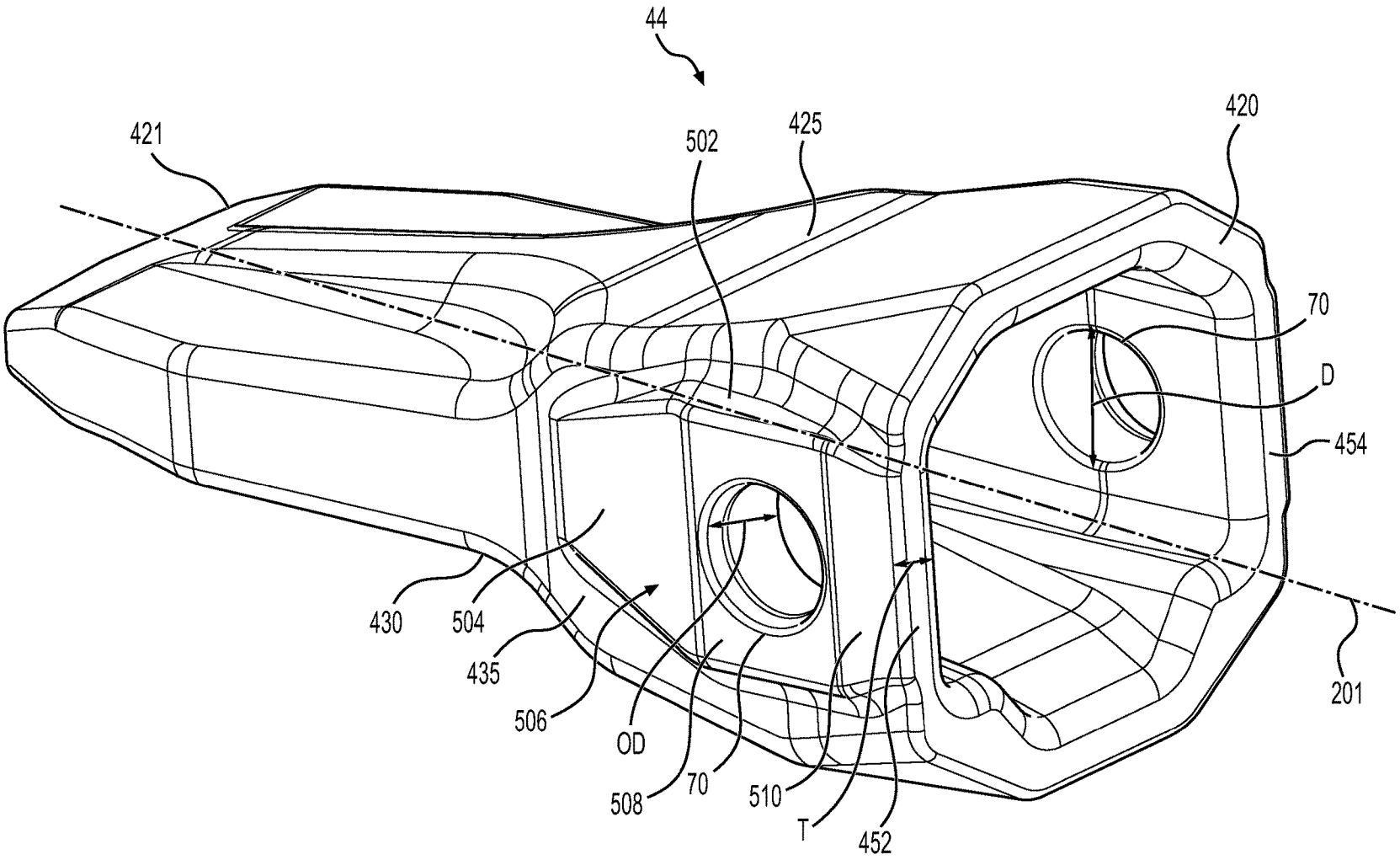
FIG. 11 is perspective view of an exemplary tip for the tip assembly of FIG. 3.

FIG. 11 depicts ground engaging tip 44 with the transverse hole 70 passing through each of lateral side walls 452, 454 for installation of the retainer 56 and the spring clip 54 (see FIG. 3). The ground engaging tip 44 may be generally wedge-shaped and have a rear edge 420 that may be configured to abut on front face 100 (see FIG. 3) of strap wall 90 (see FIG. 3) of nose 88 (see FIGS. 4-6) or symmetrical nose 102 (see FIG. 8-10). The tip 44 may have a top outer surface 425 extending forward (e.g., in a direction from adapter rear end 84 towards adapter front end 82 of FIG. 3) from a top of the rear edge 420, and a bottom outer surface 430 extending forward from a bottom of the rear edge 420 of ground engaging tip 44. The top outer surface 425 and the bottom outer surface 430 may be angled toward each other such that the top outer surface 425 and the bottom outer surface 430 converge at a front edge 421 at the front of the ground engaging tip 44. A nose cavity 440 may be defined within the ground engaging tip 44. Nose cavity 440 may extend from rear edge 420 into tip 44 in a forward direction (e.g., direction from rear edge 420 toward front edge 421). Nose cavity 440 may define a pair of lateral side walls 452, 454 that may extend between top outer surface 425 and bottom outer surface 430. Lateral side walls 452, 454 of tip 44 may include lateral outer surfaces 435 extending between the top outer surface 425 and the bottom outer surface 430 on either side of ground engaging tip 44.

Figure 12:
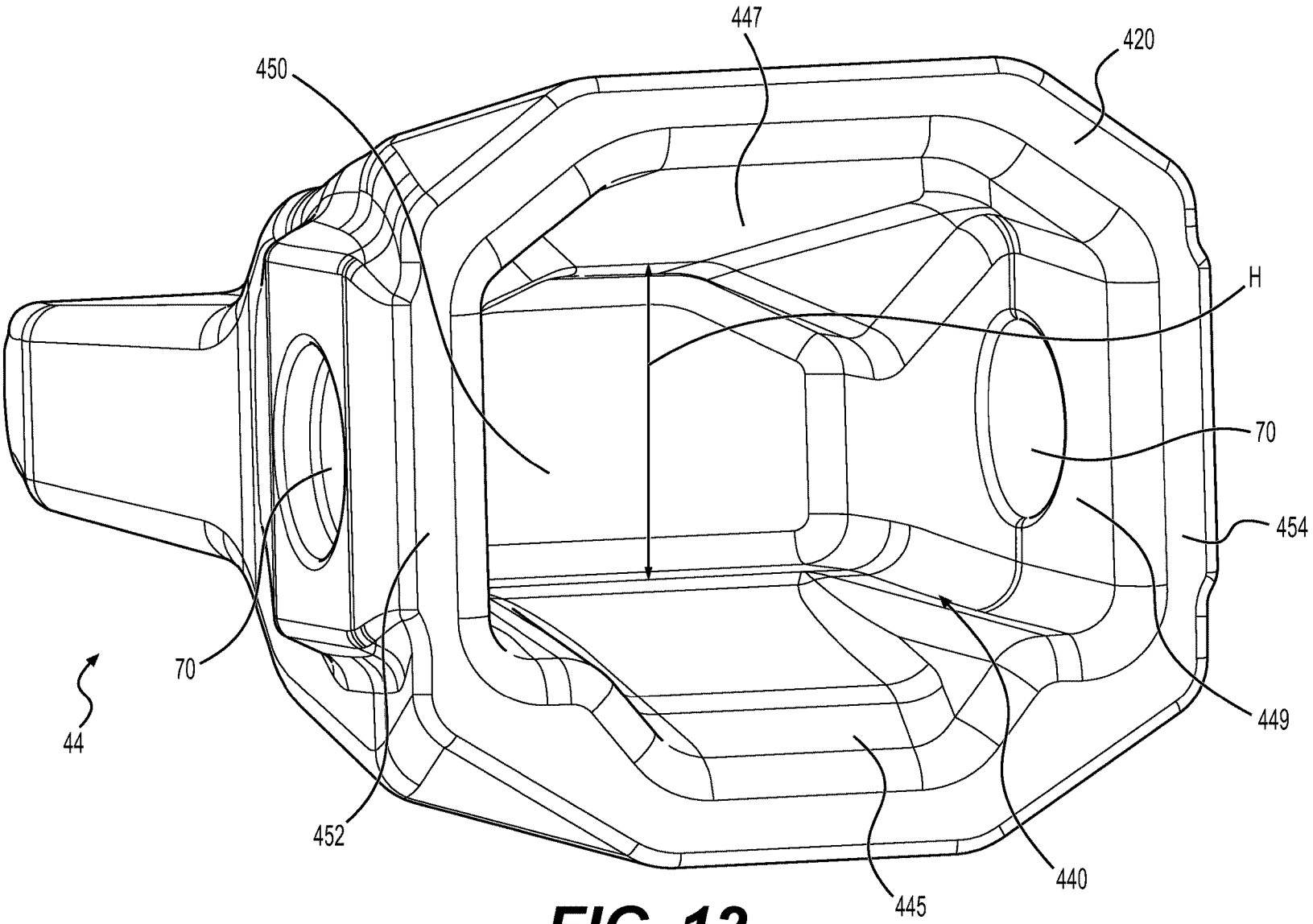
FIG. 12 is another perspective view of the tip of FIG. 11.

As depicted in FIG. 11, lateral outer surfaces 435 of ground engaging tip 44 may include transverse holes 70 in one or both of lateral side walls 452, 454 for receiving the retainer 56 (see FIG. 3) when ground engaging tip 44 is installed on the adapter 42 (see FIG. 3). Transverse hole 70 may be a thru-hole passing through one or both of lateral side walls 452 and 454 such that transverse hole 70 is in communication with nose cavity 440. One of the transverse holes 70 may be disposed on the external surface 508 of the tip ear pad 506 and an opposite end of the transverse hole 70 may be disposed on the side inner surface 449 (see FIG. 12) of the nose cavity 440. When tip 44 is attached to adapter 42, transverse hole 70 may be aligned with retainer pin opening 60 in adapter 42. In some exemplary embodiments, ground engaging tip 44 may include the transverse hole 70 on both lateral side walls 452, 454, as depicted in FIGS. 11, 12. In other exemplary embodiments, tip 44 may include the transverse hole 70 on only one of the lateral side walls 452 or 454. As illustrated in FIG. 11, the transverse hole 70 may comprise a diameter D and an opening depth OD through thickness T of lateral side wall 452 or 454. Opening depth OD may be the same depth as ground engaging tip thickness T of lateral side wall 452 or 454 or up to three times the depth of ground engaging tip thickness T. In one exemplary embodiment, as depicted in FIG. 11, opening depth OD may be twice the depth of ground engaging tip thickness T. Diameter D of the transverse hole 70 may range between 40 percent to 100 percent of height H, as depicted in FIG. 12. In one exemplary embodiment as depicted in FIG. 11 and FIG. 12, diameter D of the transverse hole 70 may be sixty percent of height H.

Ground engaging tip 44 may be configured to be received onto the nose 88 (see FIG. 4) or nose 102 (see FIG. 8). As illustrated in FIG. 12, a nose cavity 440 may be defined within the ground engaging tip 44. In some exemplary embodiments, the nose cavity 440 of tip 44 may be asymmetrical and may have a complimentary configuration to receive the nose 88. For example, asymmetrical nose cavity 440 may include a bottom inner surface 445, a top inner surface 447, a pair of opposing side inner surfaces 449, and a front inner surface 450 that may match with corresponding outer surfaces of asymmetrical nose 88 to allow asymmetrical nose 88 to be received in asymmetrical nose cavity 440. In some exemplary embodiments, the nose cavity 440 may be symmetrical and may have a complimentary configuration to receive the symmetrical nose 102. For example, the bottom inner surface 445, top inner surface 447, pair of opposing side inner surfaces 449, and front inner surface 450 may have shapes and dimensions that may match with corresponding outer surfaces of symmetrical nose 102 to allow symmetrical nose 102 to be received in symmetrical nose cavity 440.

As illustrated in FIG. 11, tip 44 may include a tip ear pad 506 that may be formed (e.g., by casting) on at least one lateral outer surface 435. Tip ear pad 506 may include tip ear pad front surface 504 that may extend rearwardly (e.g., in a direction from tip front edge 421 toward tip rear edge 420). Tip ear pad front surface 504 may be inclined outwardly relative to lateral outer surface 435 in a transverse direction (e.g., direction generally perpendicular to longitudinal axis 201 and going from lateral side wall 454 towards lateral side wall 452). Tip ear pad 506 may also include external surface 508 of the tip ear pad 506. External surface 508 may extend rearwardly from tip ear pad front surface 504. Tip ear pad 506 may include tip ear pad rear surface 510 that extend rearwardly from external surface 508. Tip ear pad rear surface 510 may connect with lateral outer surface 435 adjacent rear edge 420. Tip ear pad rear surface 510 may be inclined inwardly relative to lateral outer surface 435 in a transverse direction (e.g., direction generally perpendicular to longitudinal axis 201 and going from lateral side wall 452 towards lateral side wall 454).

Figure 14:
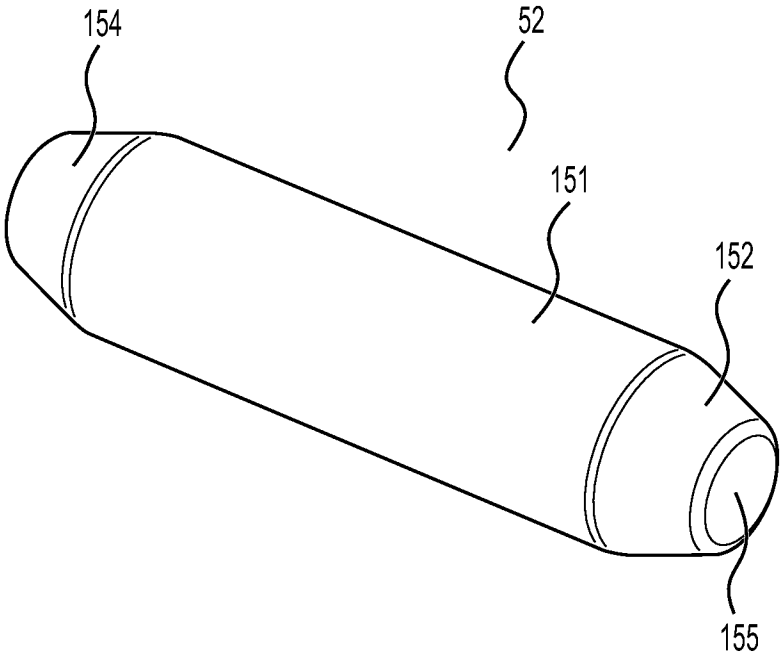
FIG. 14 is an isometric view of another exemplary pin for the tip assembly of FIG. 3.
Figure 13:
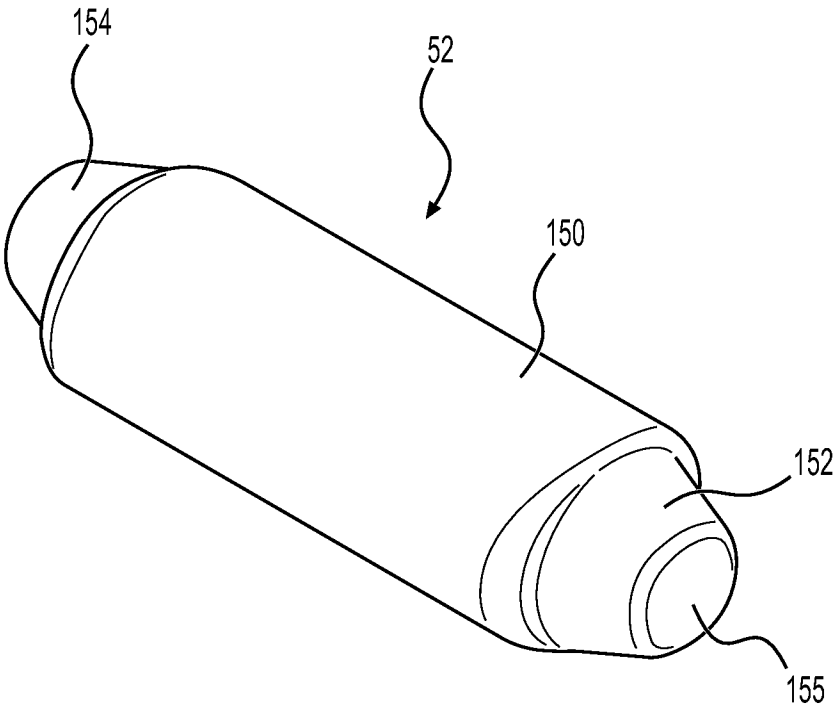
FIG. 13 is an isometric view of an exemplary pin for the tip assembly of FIG. 3.

As discussed above, the retention mechanism 50 may include a pin 52. FIG. 13 illustrates an exemplary embodiment of a pin 52. As shown in FIG. 13, the pin 52 may include an elongated shank 150 and frustoconical lugs 152, 154 extending from the shank 150 at each of the opposite ends of the shank 150. Each of the lugs 152, 154 may be configured with a profile that matches a profile of an axial cavity 172 (see FIGS. 16 and 18) extending in from one axial end of the retainer 56, 156, 256. In some exemplary embodiments as illustrated in FIG. 13, shank 150 may have a non-cylindrical shape, for example, an elliptical shape. The elliptical shape of shank 150 may correspond to the elliptical shape of retainer pin opening 60 (see FIGS. 4-10). The shank 150 may have dimensions such that shank 150 may be slidingly insertable into retainer pin opening 60 (see FIGS. 4-10). A non-circular cross-section of the shank 150 of the pin 52 may help ensure that the pin 52 is positioned correctly in the retainer pin opening 60 of nose 88 or 102 of the adapter 42. The non-circular cross-section of the shank 150 may also help prevent the pin 52 from rotating when the retainer is installed and rotated to be in a locked position as will be explained below. In some exemplary embodiments, pin 52 may have a generally cylindrically shaped shank. FIG. 14 illustrates an exemplary embodiment of a pin 52 having a generally cylindrical shank 151. Each lug 152, 154 may include an end surface 155 that may have a profile that matches a base of axial cavity 172 (see FIGS. 16 and 18). For example, in some embodiments, end surface 155 may be generally planar, while in other exemplary embodiments, end surface 155 may be curved or may have a shape that corresponds to the shape of the bottom surface 173 of axial cavity 172 (see FIGS. 16 and 18). Although elliptical and cylindrical shapes of shank 150 and 151, respectively have been discussed above, it is contemplated that the shank may have a shape that may be a square, rectangular, triangular, polygonal, or any other type of shape corresponding to a shape of retainer pin opening 60.

Figure 15:
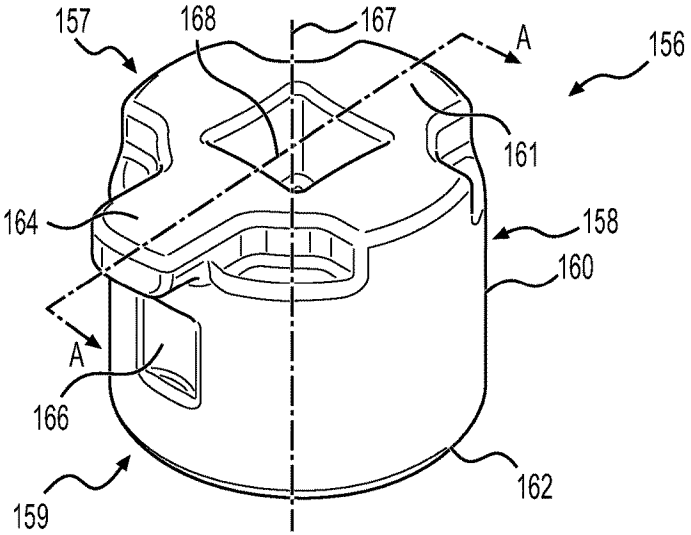
FIG. 15 is an isometric view of an exemplary retainer for the tip assembly of FIG. 3.

FIG. 15 illustrates an exemplary retainer 156 that may be included in retention mechanism 50. As illustrated in FIG. 15, retainer 156 may include a retainer body 158 that may extend from first axial end 157 to second axial end 159. Retainer body 158 may have a generally cylindrical outer surface 160, a side surface 161 at first axial end 157 and a side surface 162 at second axial end 159. Surfaces 161 and 162 may be generally parallel to each other and may be generally perpendicular to outer surface 160 of retainer body 158. Retainer 156 may include a retainer tab 164 extending radially outward from cylindrical outer surface 160 adjacent to or at first axial end 157 of retainer body 158.

Figure 16:
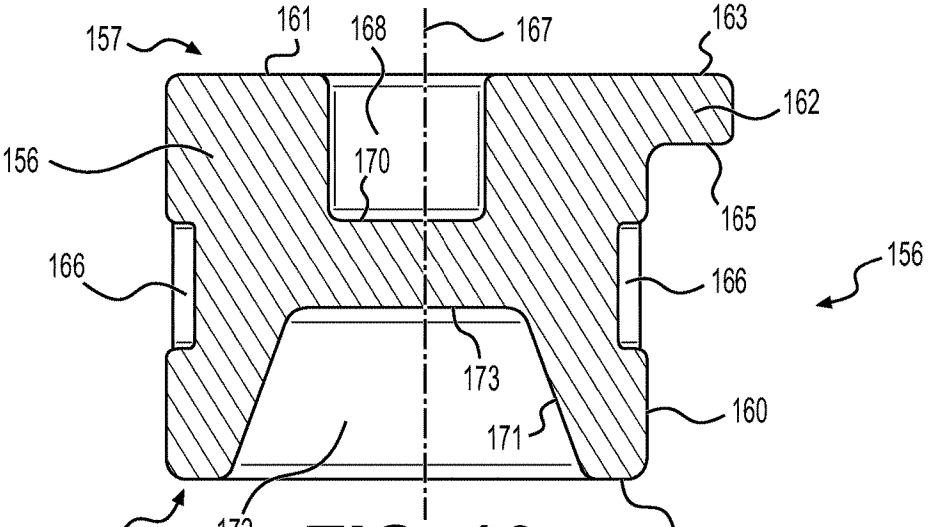
FIG. 16 is a vertical cross-sectional view along line A-A of the retainer of FIG. 15.

FIG. 16 illustrates a cross-sectional view of retainer 156 taken along line A-A of FIG. 15. As illustrated in FIG. 16, retainer tab 164 may include an outer surface 163 that may be coplanar with side surface 161 of retainer body 158. Retainer tab 164 may also include inner surface 165 that may face second axial end 159. Retainer body 158 may include one or more detent cutouts 166 that may be in the form of indentations or depressions on outer surface 160 of retainer body 158. In one exemplary embodiment as illustrated in FIGS. 15 and 16, a detent cutout 166 may be disposed at a same circumferential location as retainer tab 164 and may be positioned between retainer tab 164 and second axial end 159 of retainer body 158. It is contemplated, however, that detent cutout 166 may be disposed circumferentially offset from retainer tab 164. Retainer 156 may also include retainer socket 168. As illustrated in the exemplary embodiment of FIGS. 15 and 16, retainer socket 168 may be a cavity that may extend from side surface 161 of retainer body 158 partway into retainer body 158 towards side surface 162. As illustrated in FIG. 16, retainer socket 168 may extend into retainer body 158 partway between side surfaces 161 and 162 such that a depth of retainer socket 168 is less than a length of retainer body 158 between side surfaces 161 and 162. Retainer socket 168 may include a retainer socket base 170 that may be disposed generally perpendicular to retainer longitudinal axis 167. In one exemplary embodiment as illustrated in FIG. 15, retainer socket 168 may have a generally square shape that may allow a square drive tool to be inserted into retainer socket 168 for rotating retainer 156 about the retainer longitudinal axis 167. It is contemplated, however, that retainer socket 168 may have other shapes (e.g., rectangular, triangular, polygonal, curvilinear) that may match with a shape of the drive tool used to rotate retainer 156 about the retainer longitudinal axis 167.

As also illustrated in FIG. 16, in some exemplary embodiments, retainer 156 may include a pair of detent cutouts 166 disposed diametrically opposite to each other on outer surface 160 of retainer body 158. It is contemplated, however, that in some exemplary embodiments, detent cutouts 166 may be positioned at other, non-diametrically opposite locations on outer surface 160 of retainer body 158. Detent cutouts 166 may include indentations or depressions that may extend radially inward from outer surface 160 of retainer body 158. As further illustrated in FIG. 16, retainer body 158 may include an axial cavity 172 at second axial end 159. Axial cavity 172 may extend from side surface 161 at second axial end 159 partway into retainer body 158 toward first end 157. In some exemplary embodiments as illustrated in FIG. 8, retainer socket 168 and axial cavity 172 may be aligned about retainer longitudinal axis 167. Axial cavity 172 may include side surface 171 and bottom surface 173. Side surface 171 may have a generally conical shape that may correspond to a shape of frustoconical lugs 152, 154 of pin 52. For example, as illustrated in FIG. 16, an inner diameter or width of axial cavity 172 may decrease in a direction from side surface 162 to bottom surface 173 of axial cavity 172. Bottom surface 173 of axial cavity 172 may be disposed between retainer socket base 170 and second axial end 159. Bottom surface 173 may have a shape corresponding to end surfaces 155 of frustoconical lugs 152, 154 of pin 52 (see FIG. 13, 14).

Figure 17:
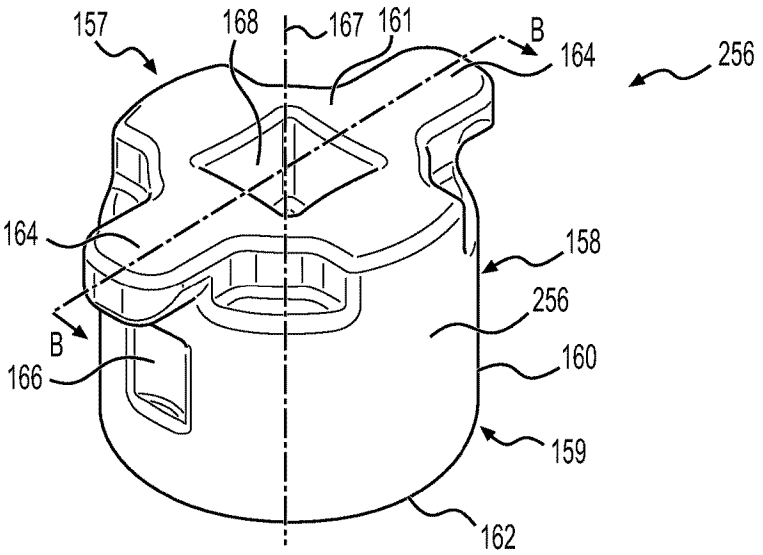
FIG. 17 is an isometric view of another exemplary retainer for the tip assembly of FIG. 3.
Figure 18:
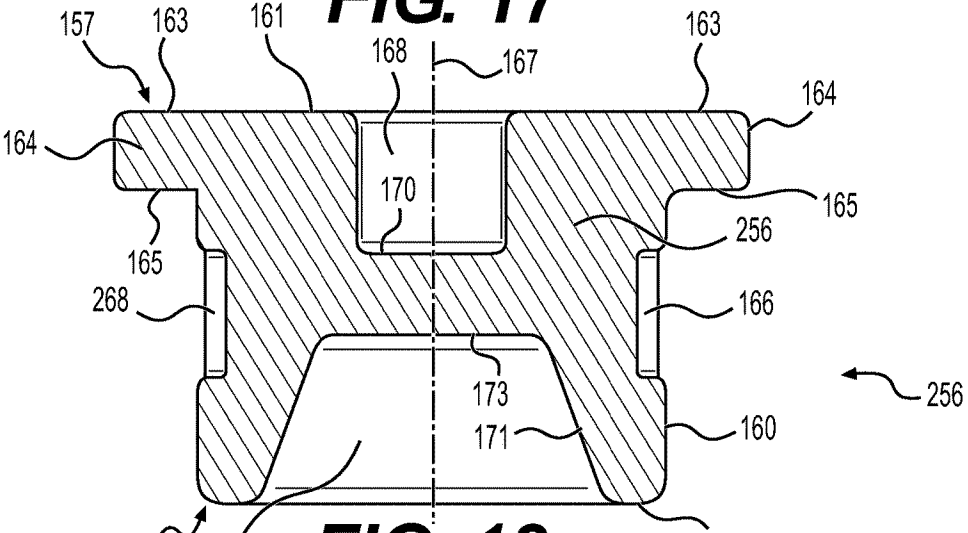
FIG. 18 is a vertical cross-sectional view along line B-B of the retainer of FIG. 17.

FIG. 17 illustrates another exemplary retainer 256 that may be included in retention mechanism 50. FIG. 18 illustrates a cross-sectional view of retainer 256 taken along line B-B of FIG. 17. Many of the features of retainer 256 may be similar to the features of retainer 156 discussed above. These similar features are labeled using the same numerical labels in FIGS. 15-18. Retainer 256 differs from retainer 156 in that retainer 256 includes a pair of diametrically oppositely disposed retainer tabs 164. As illustrated in FIGS. 17 and 18, retainer tabs 164 may extend radially outward from cylindrical outer surface 160 adjacent first axial end 157 of retainer body 158. As illustrated in FIG. 18, retainer tabs 164 may include an outer surface 163 that may be coplanar with side surface 161 of retainer body 158. Retainer tabs 164 may also include inner surface 165 that may face second axial end 159. Retainer body 158 may include one or more detent cutouts 166 that may be in the form of indentations or depressions on outer surface 160 of retainer body 158. In one exemplary embodiment as illustrated in FIGS. 17 and 18, detent cutouts 166 may be disposed at a same circumferential location as retainer tabs 164 and may be positioned between retainer tabs 164 and second axial end 159 of retainer body 158. It is contemplated, however, that detent cutouts 166 may be disposed circumferentially offset from retainer tabs 164. Retainer 256 may include retainer socket 168 and axial cavity 172 that may include features similar to those discussed above with respect to retainer 156. Some alternative embodiments of the retainer 56, 156, 256 may include a protrusion in the form of at least a partial male thread formed around an outer peripheral surface at the first axial end 157 of the retainer 56, 156, 256 rather than the one or more tabs 164. The male thread or partial male thread may be configured to threadedly engage with a female threaded portion 514 (see FIGS. 21, 23, 25, 26) along the inner circumferential wall of the outer opening portion of the transverse hole 70 in a lateral side wall of the tip 44 as will be described below.

Figure 19:
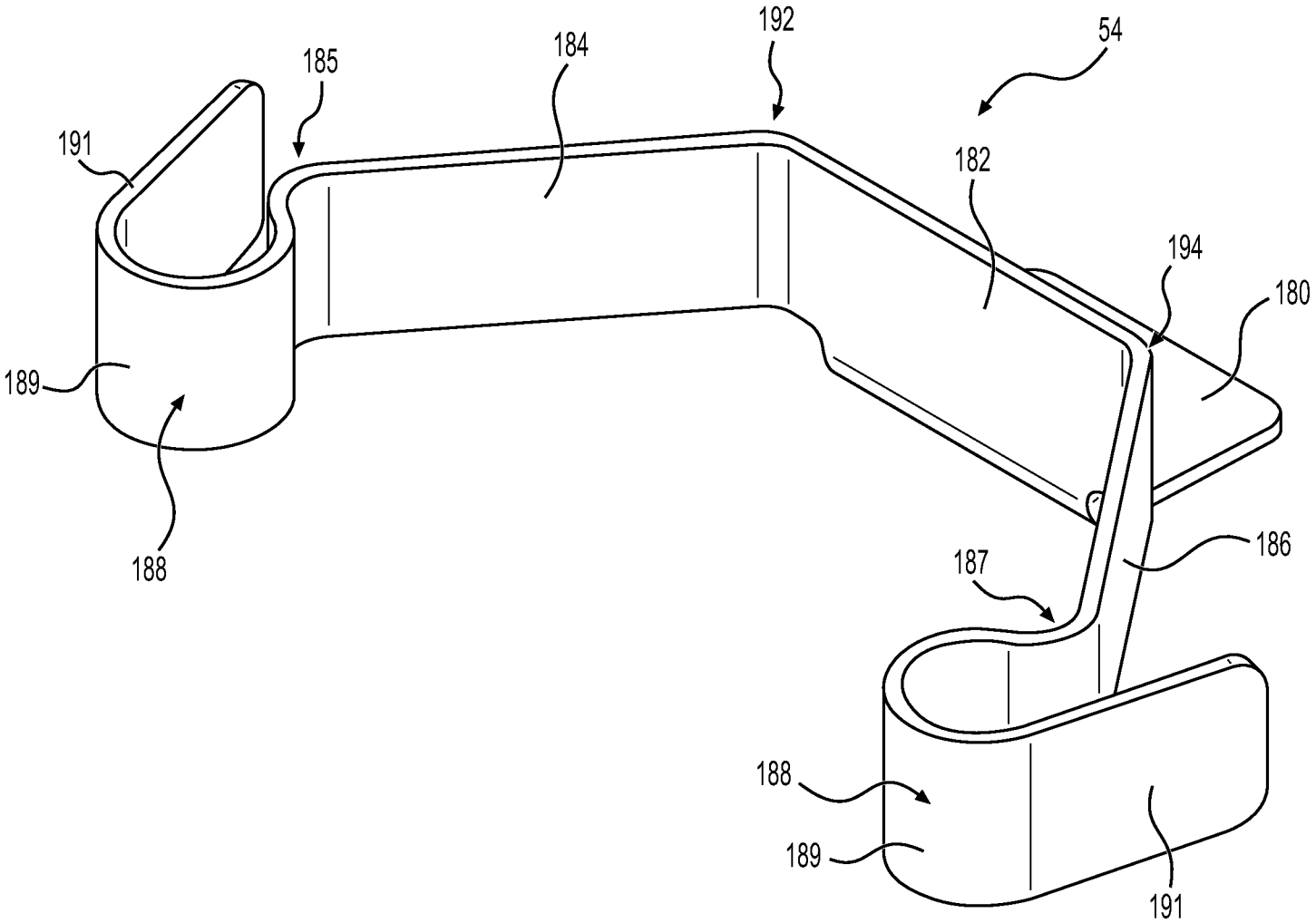
FIG. 19 is an isometric view of an exemplary spring clip for the tip assembly of FIG. 3.

FIG. 19 illustrates an exemplary spring clip 54 of retention mechanism 50. The spring clip 54 may include a bottom leg 180 that may be configured to anchor the spring clip 54 in position relative to the transverse hole 70 and the tip 44 (see FIG. 3, 11, 12). As will be described below, bottom leg 180 may be configured to engage with a cutout 522 (see FIGS. 22, 24) formed into the side inner surface 449 of the nose cavity 440 and on the lateral side wall 452, 454 of the tip 44. The spring clip 54 may include a base portion 182 that may protrude from one edge of the bottom leg 180 and may be disposed generally perpendicular to bottom leg 180. A pair of flexible arms 184, 186 may extend outwardly from opposite ends 192, 194, respectively, of the base portion 182. The flexible arms 184, 186 of the spring clip 54 may form two diverging walls that may be generally perpendicular to the plane of the bottom leg 180. The flexible arms 184, 186 may be disposed at obtuse angles of inclination relative to base portion 182. The flexible arms 184, 186 may be configured to tightly grip outer surface 160 of retainer body 158 of retainers 56, 156, 256 (see FIGS. 3, 15-18). As further illustrated in FIG. 19, flexible arms 184, 186 of the spring clip 54 may terminate at distal ends 185, 187, respectively, in detent portions 188 configured to engage with detent cutouts 166 (see FIGS. 15-18) formed into the outer surface 160 of the retainer 56, 156, 256 when the retainer has been fully engaged into transverse hole 70. Each detent portion 188 may include a hook 189 (e.g., C-shaped or U-shaped) that may be in the form of a partial cylinder or other curvilinear shape and a planar wall 191 extending from hook 189. Planar walls 191 may be angled relative to flexible arms 184, 186 at acute angles. Hook 189 may have an outer surface that may engage with detent cutouts 166. The spring clip 54 may be formed from plastic, rubber, metal, or other materials with elastic properties such that the flexible arms 184, 186 of the spring clip 54 can be flexed apart to allow arms 184, 186 to tightly grip outer surface 160 (see FIGS. 15-18) of retainer 56, 156, or 256

Figure 20:
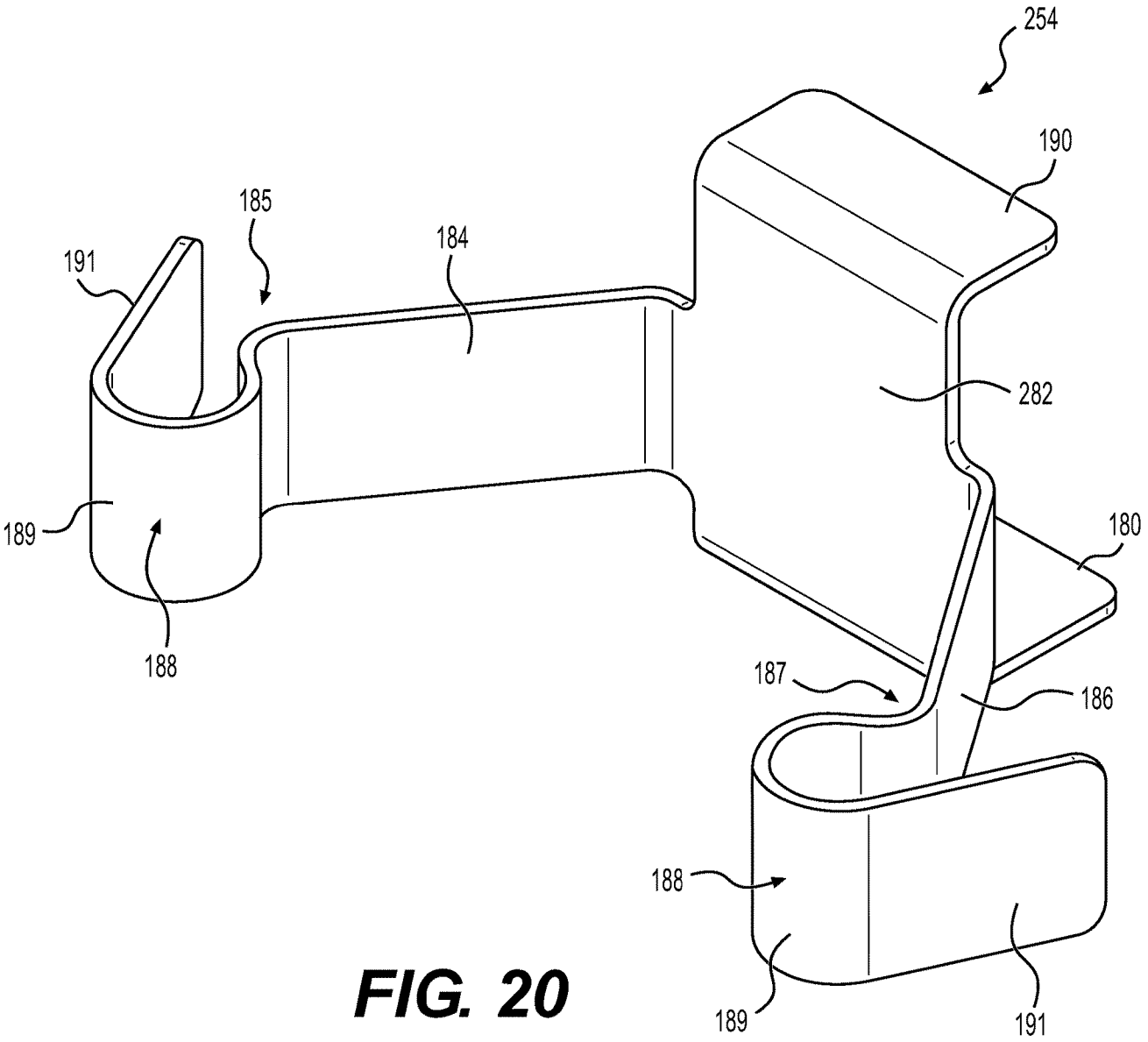
FIG. 20 is an isometric view of another exemplary spring clip for the tip assembly of FIG. 3.

FIG. 20 illustrates another exemplary spring clip 254 that may be used in retention mechanism 50 instead of spring clip 54. Many of the features of the spring clip 254 are similar to those of the spring clip 54 discussed above. These common features are labeled using the same numerical labels in FIGS. 19 and 20. Like the spring clip 54, the spring clip 254 may also include a bottom leg 180 that may be configured to anchor the spring clip 254 in position relative to the transverse hole 70 and the tip 44 (see FIG. 3, 11, 12). The spring clip 254 may include a base portion 282 that may extend from one edge of the bottom leg 180 and may be disposed generally perpendicular to bottom leg 180. Base portion 282 may extend from bottom leg 180 to a top leg 190. Like bottom leg 180, top leg 190 may also be attached to base portion 182 such that bottom leg 180 and top leg 190 may be spaced apart from each other. Both the bottom leg 180 and the top leg 190 may be disposed generally parallel to each other and generally perpendicular to base portion 282 such that the base portion 282, bottom leg 180, and top leg 190 form a C-Shaped or U-Shaped bracket. As will be described below, bottom leg 180 may be configured to engage with a cutout 522 (see FIGS. 22, 24) formed into the side inner surface 449 of the nose cavity 440 and on the lateral side wall 452 or 454 of the tip 44. The spring clip 254 may also include a pair of flexible arms 184, 186 that may extend outwardly from opposite ends of the base portion 182. In one exemplary embodiment as illustrated in FIG. 20, flexible arms 184 and 186 may be disposed adjacent to the bottom leg 180 and spaced apart from the top leg 190 of the spring clip 254. Flexible arms 184, 186 of the spring clip 54 may form two diverging walls that are generally perpendicular to the plane of the bottom leg 180. The flexible arms 184, 186 may be disposed at obtuse angles of inclination relative to base portion 182. The flexible arms 184, 186 may be configured to tightly grip outer surface 160 of retainer body 158 of retainers 56, 156, 256 (see FIGS. 3, 15-18). As further illustrated in FIG. 20, each of the flexible arms 184, 186 of the spring clip 54 may terminate at a distal end 185, 187, respectively in a detent portion 188 similar to the detent portion described above for spring clip 54. Detent portions 188 of spring clip 254 may be configured to engage with detent cutouts 166 formed into the outer surface 160 of the retainer 56, 156, 256 when the retainer has been fully engaged in a locked position into transverse hole 70, as will be described below.

As illustrated in FIGS. 3 and 11, tip 44 may include a tip ear pad 506 that may be formed (e.g., by casting or machining) on at least one lateral outer surface 435 (see FIG. 11) of the tip 44 and that may be configured with the transverse holes 70 passing through the lateral side wall 452 and/or 454 (see FIG. 11) of the tip 44 in a direction perpendicular to a coextensive central longitudinal axis 201 (see FIGS. 3 and 11) of the tip 44 and the adapter 42 when the tip 44 is assembled on the nose 88 or 102 of the adapter 42.

Figure 21:
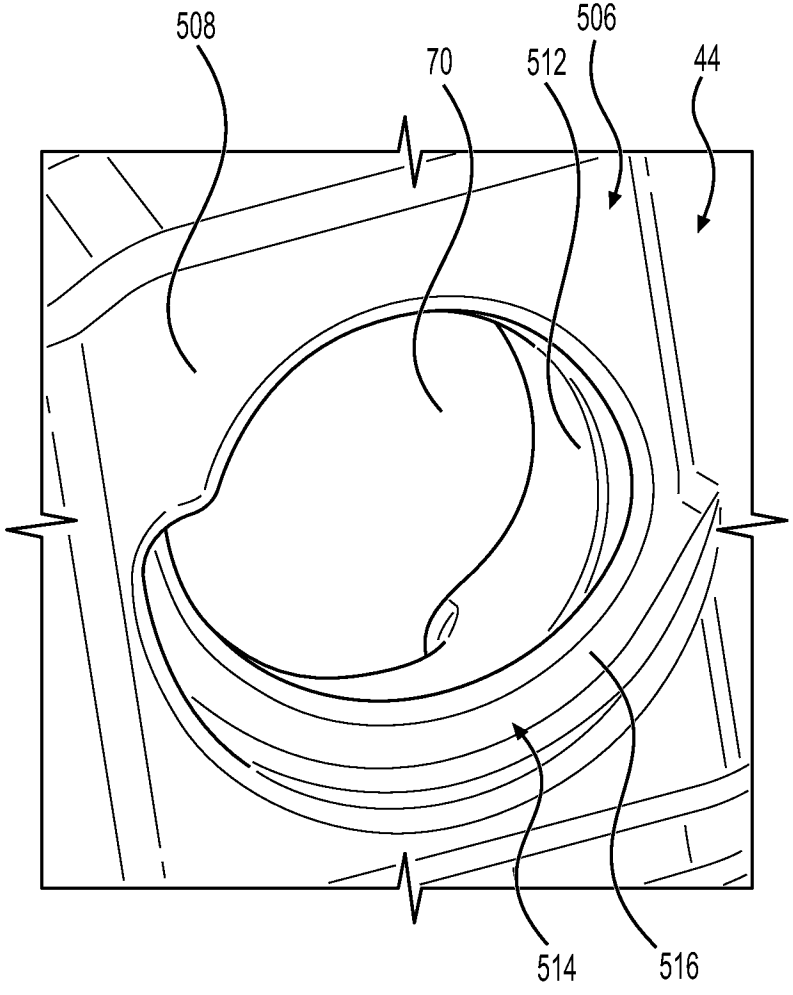
FIG. 21 is a magnified outer side view of an exemplary transverse hole in the tip of FIGS. 11 and 12.

FIG. 21 is a perspective view of the tip ear pad 506 looking inwardly into the nose cavity of the tip 44 through the transverse hole 70. As illustrated in FIG. 21, the transverse hole may include a partial female thread/ramp 514 that may be defined part way around an inner circumferential wall 512 of the transverse hole 70 through the lateral side wall 452 or 454 of tip 44 (see FIG. 11). The partial female thread 514 may help reduce an amount of material that protrudes from the outer surface of the sidewall of the tip 44 along the tip ear pad side surfaces 502 and tip ear pad front surface 504 of the tip ear pad 506. The partial female thread 514 may also help reduce the distance between an external surface 508 of the tip ear pad 506 and the surrounding lateral outer surface 435 of the lateral side wall 452 or 454 of the tip 44 (see FIG. 11). The one or more retainer tabs 164 extending radially outward from the outer surface 160 at the first axial end 157 of the retainer 56, 156, 256, as shown in FIGS. 15-18, may engage with an external surface 516 of the partial female thread 514 as the retainer is threadedly engaged in the transverse hole 70. Rotation of the retainer 56, 156, 256 into threaded engagement of the one or more retainer tabs 164 with the partial female thread 514 and into a locked position may result in the one or more tabs 164 sliding along an inclined or ramp-like surface (e.g., external surface 516) of the female thread 514 and passing underneath a portion of the female thread 514 such that an internal surface 518 of the female thread 514 (see FIGS. 23, 24) may form a ledge 520 (see FIG. 23) that prevents removal of the retainer 56, 156, 256 in an axial direction (e.g., perpendicular to longitudinal axis 201 of FIG. 2) without counter-rotating the retainer 56, 156, 256 to unthread it from the female thread 514 in the transverse hole 70 through the lateral side wall 452 or 454 of the tip 44.

Various alternative embodiments may include a tip ear pad 506 on either side of the tip 44, or on both of the opposite sides of the tip 44. Each tip ear pad 506 may include features configured to accommodate the retention mechanism 50 on one or both sides of the tip 44 and the nose 88 or 102 of the adapter 42. Inclusion of the retention mechanism 50 according to various embodiments of this disclosure on only one side of the tip 44 and adapter 42 may provide greater ease of manufacturing, simplified installation, and less expense, while inclusion of a retainer system on both sides of the tip and adapter may provide an extra layer of security in case one side fails.

Figure 22:
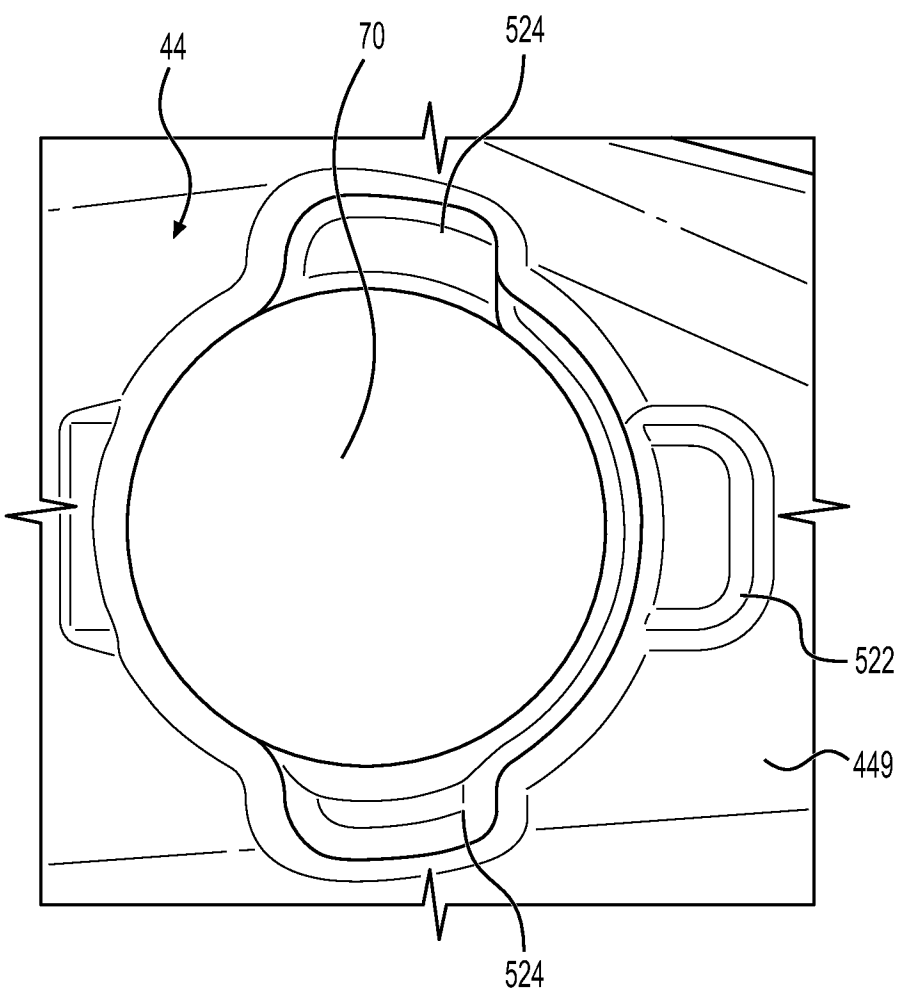
FIG. 22 is a magnified exemplary inner side view of the transverse hole of FIG. 21.

FIG. 22 is a perspective view of the side inner surface 449 (see FIG. 12) looking outwardly from nose cavity 440 of the tip 44 through the transverse hole 70. As illustrated in FIG. 22, a cutout 522 may be formed into the side inner surface 449 of the nose cavity 440 in the tip 44. The cutout 522 may extend radially outwardly from an inner extent of the transverse hole 70. The cutout 522 may be in the form of a recess or depression that may extend only partway into a thickness of lateral side walls 452 and/or 454. The cutout 522 may be configured to receive the bottom leg 180 of the spring clips 54, 254. Allowing the bottom leg 180 of the spring clip 54, 254 to be anchored to the cutout 522 may help prevent rotation of the spring clips 54, 254 when the retainer 56, 156, 256 is rotated about retainer longitudinal axis 167 (see FIGS. 15-18) when the retainer 56, 156, 256 is installed in the tip assembly 20. As also illustrated in FIG. 22, one or more additional cutouts 524 may also be formed into the side inner surface 449 of the nose cavity 440 in the tip 44. The cutouts 524 may extend radially outwardly from an inner extent of the transverse hole 70 and may be in the form of recesses or depressions. In one exemplary embodiment as illustrated in FIG. 22, the cutouts 524 may be disposed diametrically opposite to each other although other arrangements of the cutouts 524 are also contemplated. In the exemplary embodiment illustrated in FIG. 22, a central axis of the cutouts 524 may be disposed generally perpendicular to a central axis of the cutout 522. The transverse hole 70 as illustrated in FIGS. 19 and 20 may allow the spring clip 54, 254 to be installed in tip 44 by inserting the spring clip 54, 254 via the nose cavity 440 such that the bottom leg 180 of the spring clip 54 may be received in cutout 522. The planar walls 191 of the detent portions 188 of the spring clip 54 or 254 (see FIGS. 19, 20) may extend into the cutouts 524 when the hooks 189 of the detent portions 188 (see FIGS. 19, 20) are not engaged with the detent cutouts 166 on outer surface 160 of retainer body 158 (see FIGS. 15-18).

Figure 23:
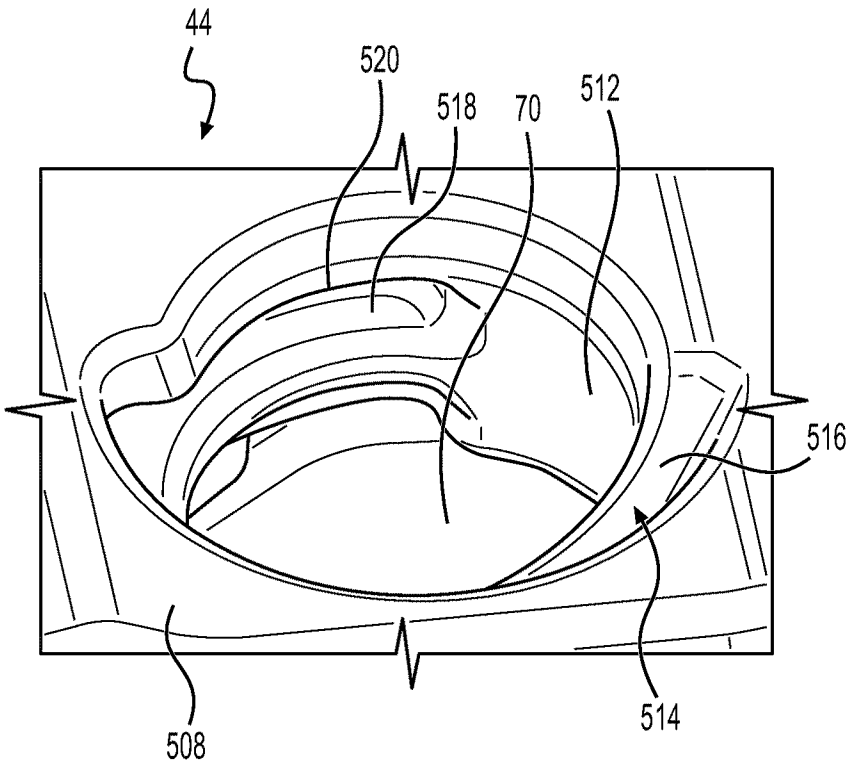
FIG. 23 is another magnified outer side view of the exemplary transverse hole of FIG. 21.

FIG. 23 is another perspective view of the tip ear pad 506 looking inwardly into the nose cavity of the tip 44 through the transverse hole 70. As illustrated in FIG. 23, the female thread/ramp 514 may be inclined relative to lateral outer surface 435 and/or tip ear pad external surface 508 such that the female thread 514 may slope inwards (e.g., in a direction from lateral outer surface 435 towards side inner surface 449 of lateral side wall 452 or 454. When retainer 56, 156, 256 is inserted into the transverse hole 70 and rotated, retainer tab 164 may slide on an external surface 516 of a helical ramp segment of the female thread 514. Rotation of retainer 56, 156, 256 may stop when retainer tab 164 is received between external surface 516 of the partial female thread 514 and ledge 520.

Figure 24:
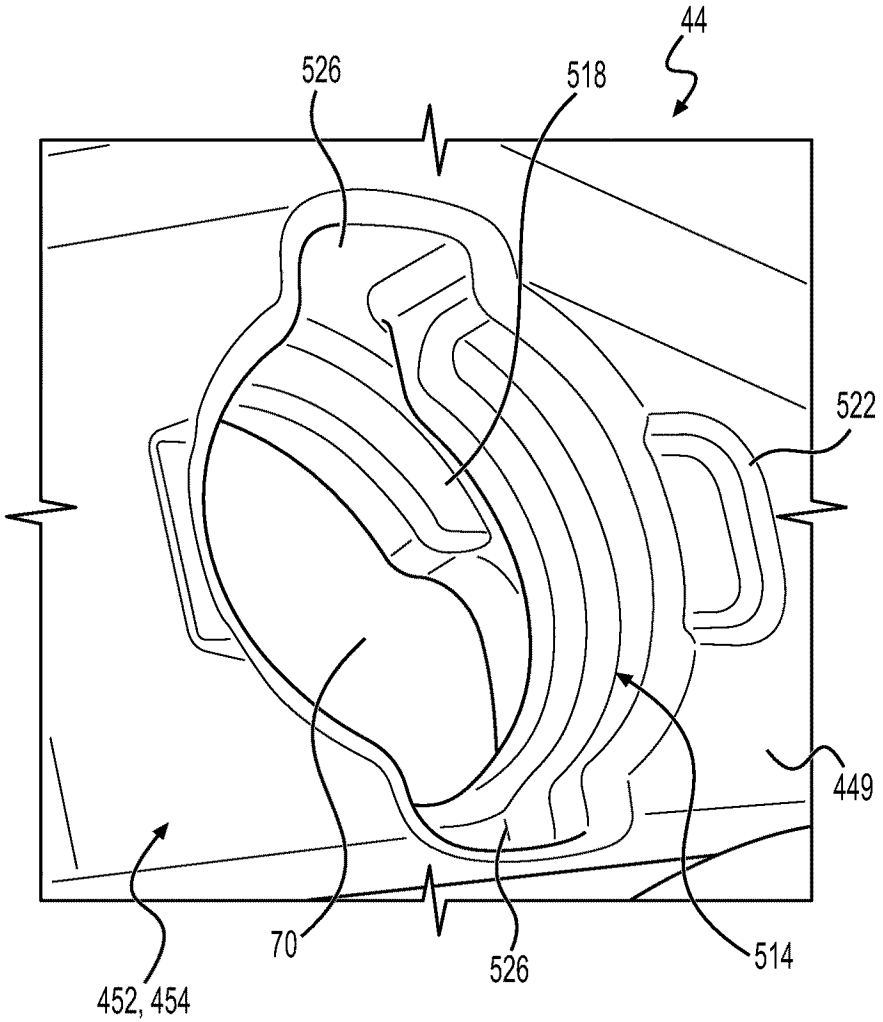
FIG. 24 is another magnified exemplary inner side view of the transverse hole of FIG. 21.

FIG. 24 is a perspective view of another embodiment of the side inner surface 449 (see FIG. 12) looking outwardly from nose cavity 440 of the tip 44 through the transverse hole 70. Unlike the embodiment of FIG. 22, the embodiment of FIG. 24 allows the spring clips 54, 254 to be inserted either from outside the tip 44 or from within the nose cavity 440. As illustrated in FIG. 24, a cutout 522 may be formed into the side inner surface 449 of the nose cavity 440 in the tip 44. The cutout 522 may extend radially outwardly from an inner extent of the transverse hole 70. The cutout 522 may be in the form of a recess or depression that may extend only partway through a thickness of the lateral sidewall 452 and/or 454. The cutout 522 may be configured to receive the bottom leg 180 of the spring clips 54, 254. Allowing the bottom leg 180 of the spring clip 54, 254 to be anchored to the cutout 522 may help prevent rotation of the spring clips 54, 254 when retainer 56, 156, 256 is rotated about retainer longitudinal axis 167 (see FIGS. 15-18) when retainer 56, 156, 256 is installed in tip assembly 20.

As also illustrated in FIG. 24, one or more cutouts 526 may be formed into the side inner surface 449 of the nose cavity 440 in the tip 44. The cutouts 526 may extend radially outwardly from an inner extent of the transverse hole 70. Unlike the cutouts 524 (see FIG. 22), however, the cutouts 526 may extend through the thickness of lateral side walls 452 or 454 such that the cutouts 526 are in communication with the transverse hole 70. In one exemplary embodiment as illustrated in FIG. 24, the cutouts 526 may be disposed diametrically opposite to each other although other arrangements of the cutouts 526 are also contemplated. A central axis of the cutouts 526 may be disposed generally perpendicular to a central axis of the cutout 522. The transverse hole 70 as illustrated in FIGS. 19 and 20 may allow the spring clip 54, 254 to be installed in tip 44 by inserting the spring clip 54, 254 via the nose cavity 440 or from outside the tip 44 in a direction from lateral outer surface 435 towards side inner surface 449. Because the cutouts 526 extend through a thickness of lateral side wall 452, it may be possible to insert the spring clip 54, 254 from outside the tip 44 in a direction from lateral outer surface 435 towards side inner surface 449, such that the detent portions 188 of the spring clip 54 or 254 (see FIGS. 19, 20) may be received in the cutouts 526. The detent portions 188 of the spring clip 54 or 254 see FIGS. 19, 20) may extend into the cutouts 526 when the detent portions 188 are not engaged with the detent cutouts 166 (see FIGS. 15-18) on the outer surface 160 of the retainer body 158.

Figure 26:
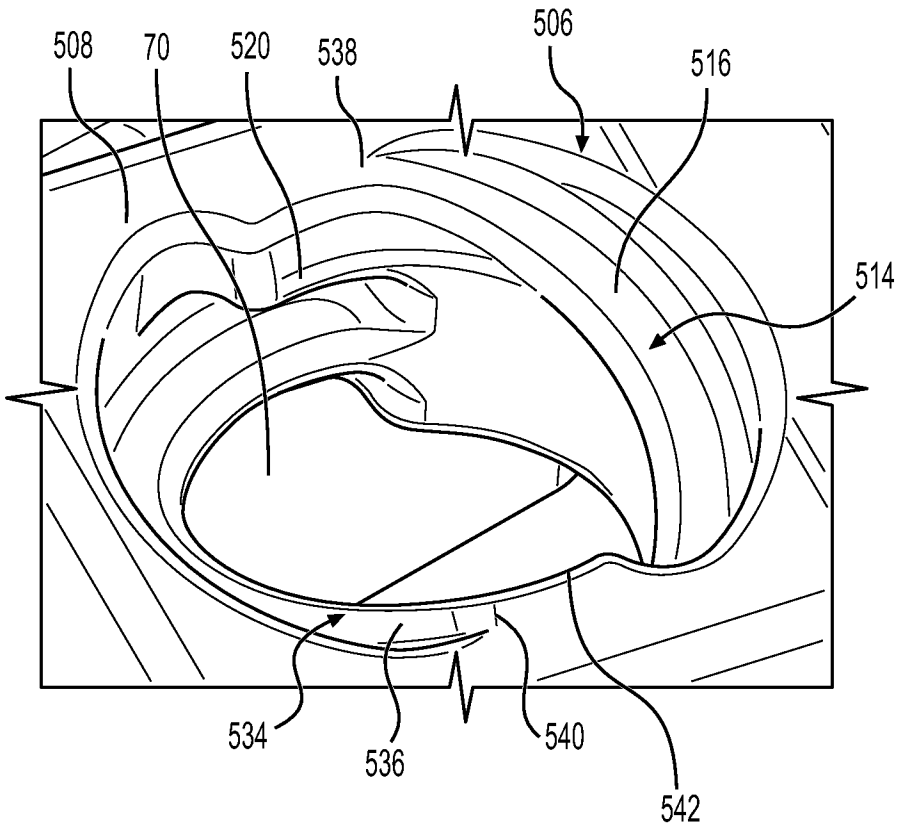
FIG. 26 is a magnified exemplary inner side view of the transverse hole of FIG. 25.
Figure 25:
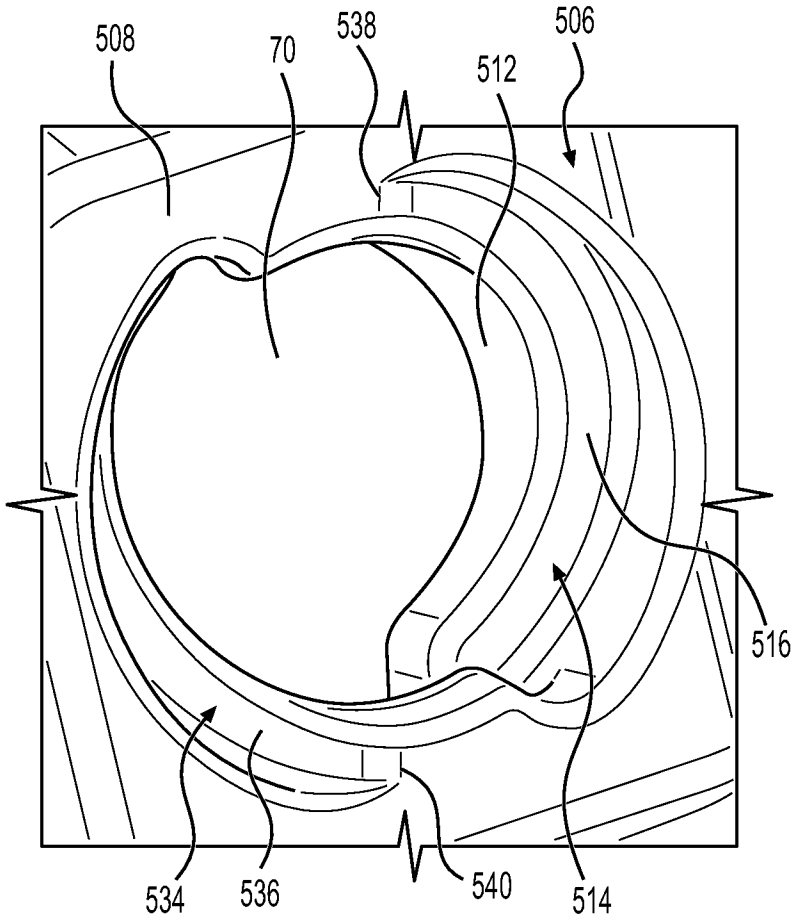
FIG. 25 is a magnified outer side view of another exemplary transverse hole in the tip of FIGS. 11 and 12.

FIGS. 25 and 26 are perspective views of another embodiment of the tip ear pad 506 looking inwardly into the nose cavity of the tip 44 through the transverse hole 70 that allows for use of a retainer 256 that may have a pair of tabs 164. The tip ear pad 506 and transverse hole 70 embodiment of FIGS. 25 and 26 may allow for installation of retainer 256 having two diametrically opposed retainer tabs 164. As illustrated in FIG. 25, the partial female thread/ramp 514 may be defined part way around an inner circumferential wall 512 of the transverse hole 70 through the lateral side wall 452 or 454 of tip 44 (see FIG. 11). Likewise the partial female thread/ramp 534 may be defined part way around an inner circumferential wall 512 of the transverse hole 70. In one exemplary embodiment as illustrated in FIG. 23, the partial female thread 514 may begin at a circumferential location 538 and the partial female thread 534 may begin at a circumferential location 540 located diametrically opposite to circumferential location 538 and each of the partial female threads 514 and 534 may extend halfway (e.g., spanning an angle of) 180° around inner circumferential wall 512. It is contemplated, however, that one or both of the partial female threads 514 and 534 may span an angle more than or less than 180° (e.g., 90°, 360° or any other angle) as the partial female threads 514 and 534 extend around the circumference of transverse hole 70. As also illustrated in FIG. 26, the partial female thread 514 may be inclined relative to lateral outer surface 435 and/or external surface 508 of the tip ear pad 506 such that an external surface 516 of the partial female thread 514 may slope inwards (e.g., in a direction from lateral outer surface 435 towards side inner surface 449 of lateral side wall 452 or 454. Likewise, the partial female thread 534 may be inclined relative to lateral outer surface 435 and/or external surface 508 of the tip ear pad 506 such that an external surface 536 of the partial female thread 534 may slope inwards (e.g., in a direction from lateral outer surface 435 towards side inner surface 449 of lateral side wall 452 or 454. When retainer 256 with two tabs 164 is inserted into the transverse hole 70 and rotated, retainer tabs 164 may slide on external surfaces 516, 536 of ramps 514, 534, respectively. Rotation of retainer 256 may stop when one of the retainer tabs 164 is received between external surface 516 of ramp 514 and ledge 520 and/or the other of the retainer tabs 164 is received between external surface 536 of ramp 514 and ledge 542. Ledges 520 and 542 may help prevent removal of the retainer 256 in an axial direction (e.g., perpendicular to longitudinal axis 201 of FIG. 2) without counter-rotating the retainer 256 to unthread it from the partial female thread/ramps 514 and 534 in the transverse hole 70.

Figure 27:
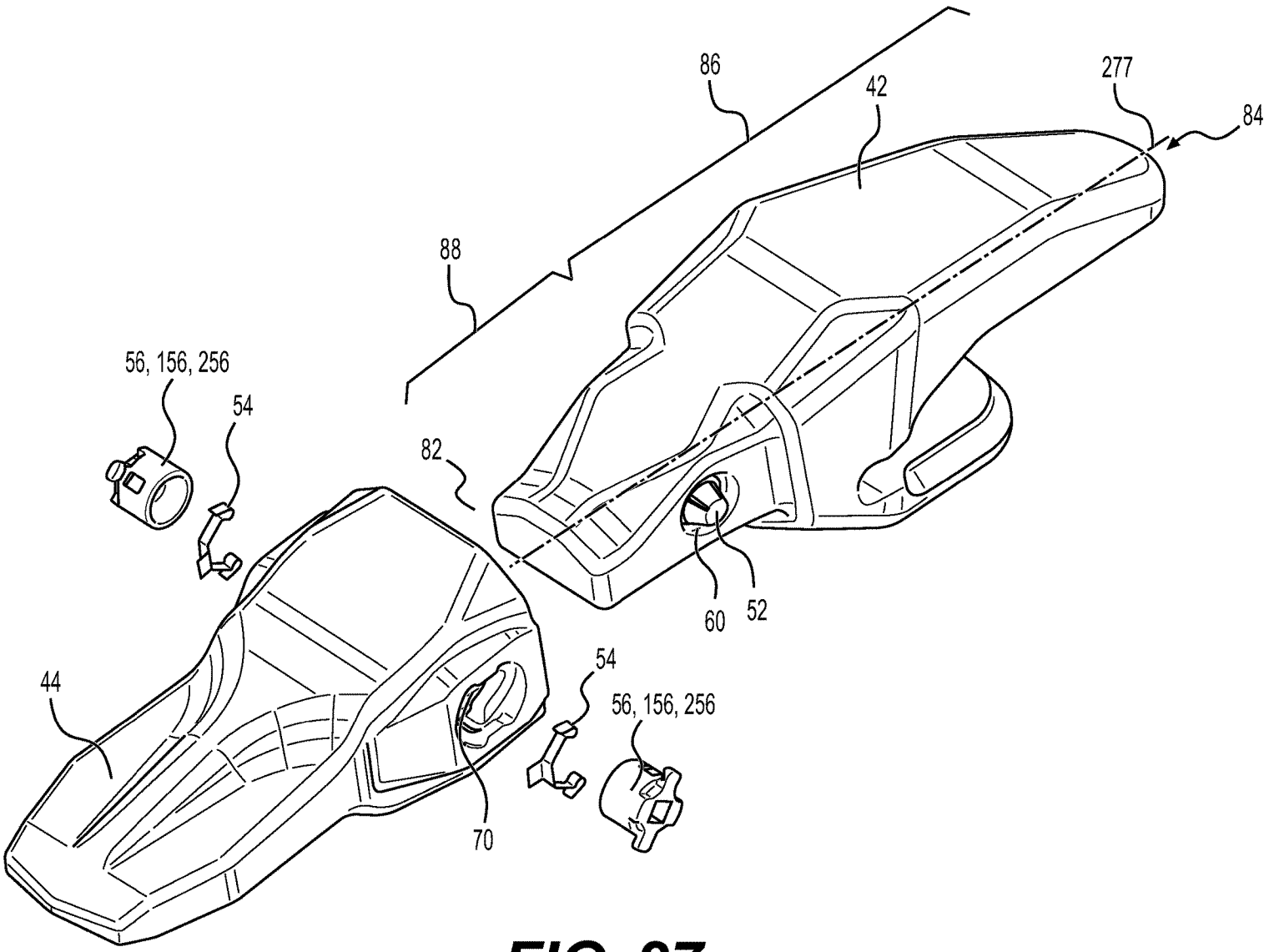
FIG. 27 is an exploded perspective view of the tip assembly of FIG. 3 with the pin assembled in the adapter.
Figure 28:
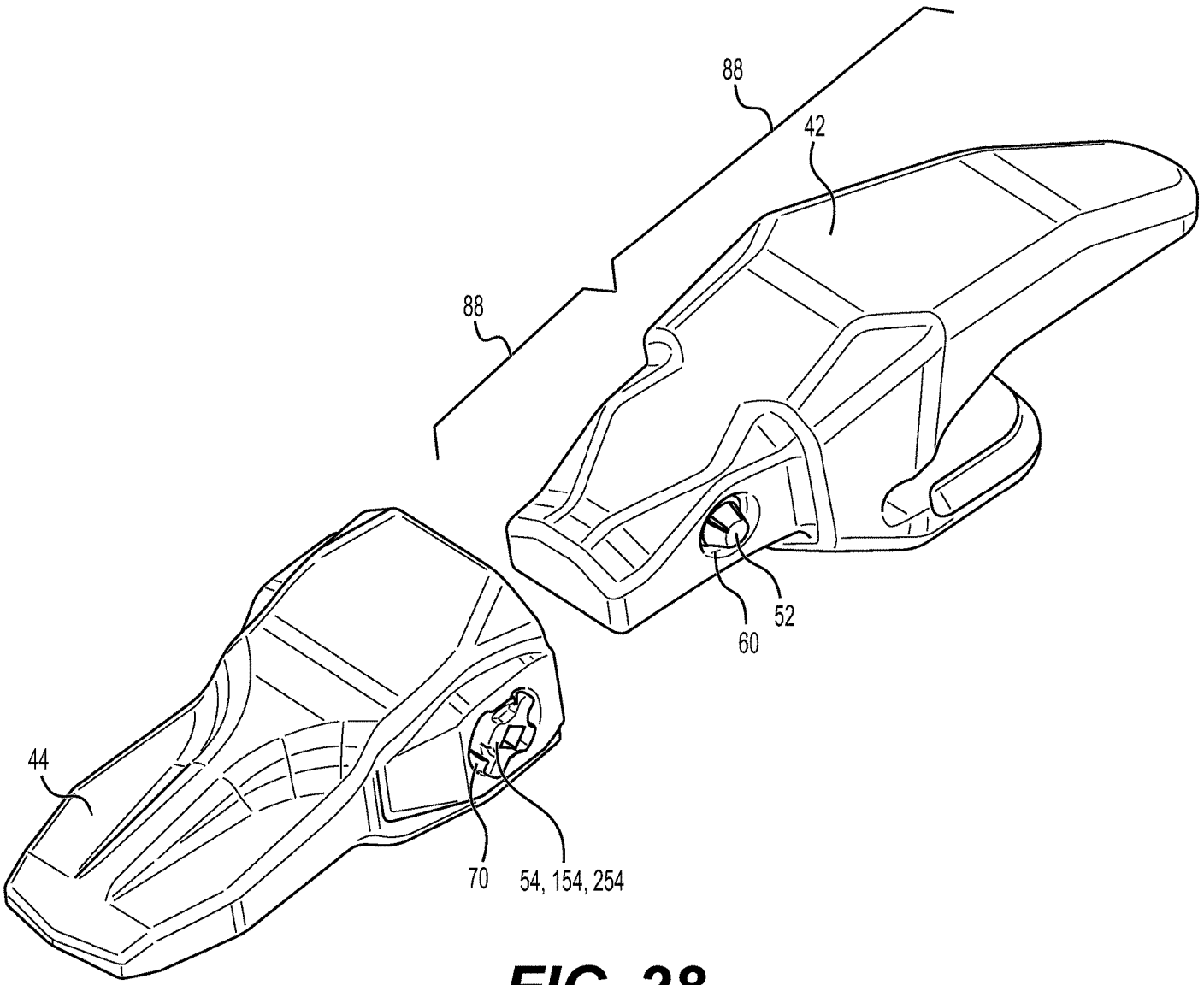
FIG. 28 is an exploded perspective view of the tip assembly of FIG. 26 with retainers and spring clips assembled in the tip.
Figure 29:
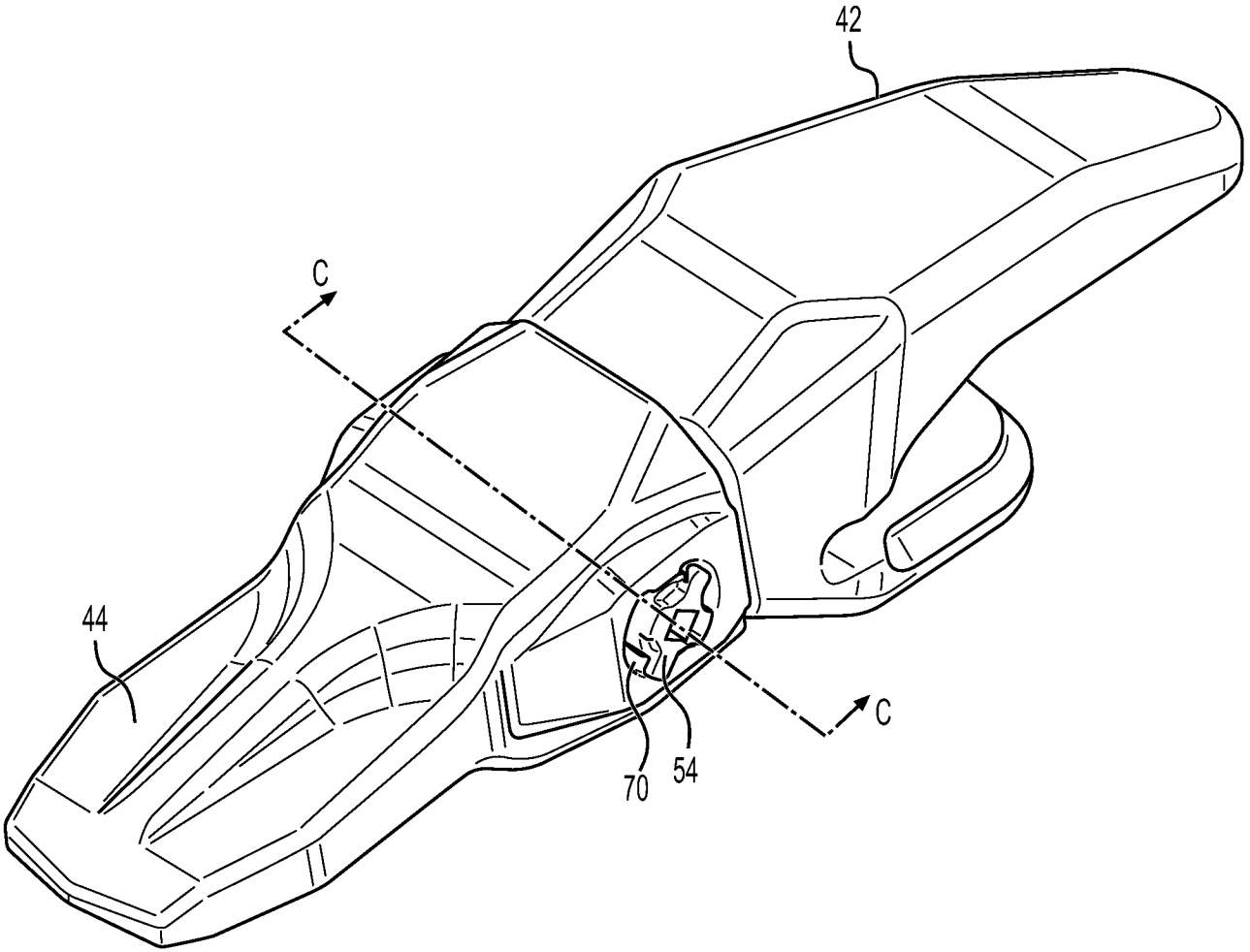
FIG. 29 is perspective view of the tip assembly of FIG. 28 with the tip attached to the adapter and with the retainer in an unlocked position.

FIG. 27-36 display various stages of assembly of tip 44 onto adapter 42. As illustrated in FIG. 27, the first step in assembly of the tip 44 onto the adapter 42 may include inserting the pin 52 into the retainer pin opening 60 in the nose 88 of the adapter 42. The spring clip 54 or 254 may also be inserted into a first end of the transverse hole 70 of tip 44 from within nose cavity 440 or into a second end of the transverse hole 70 from outside the nose cavity 440 in a direction generally perpendicular to longitudinal axis 201. As illustrated in FIG. 28, retainer 256 may then be inserted into the transverse hole 70 through the first end of the transverse hole 70 such that flexible arms 184, 186 of the spring clip 54 may engage with and grip the outer surface 160 of the retainer body 158. After installing the retainer 256, the tip 44 may be attached to the adapter 42 such that the nose 88 may be receive in nose cavity 440. FIG. 29 illustrates the tip 44 with the retainer 256 attached to the adapter 42.

Figure 31:
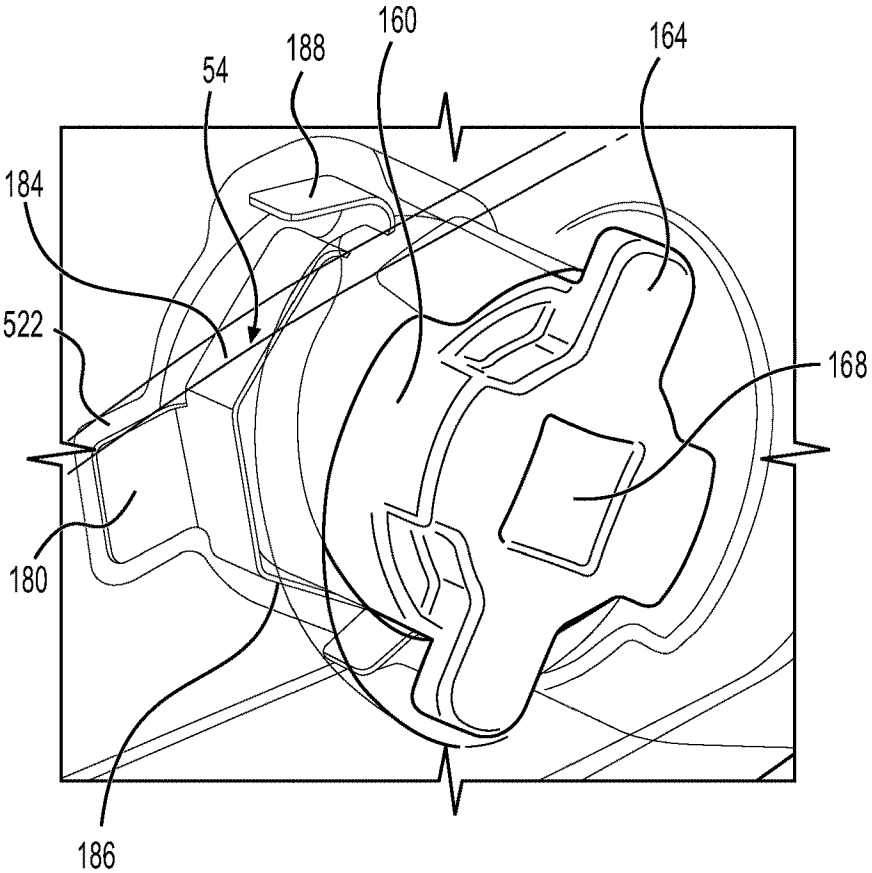
FIG. 31 depicts a three dimensional rendering of retainer in an unlocked position in the tip assembly of FIG. 29.
Figure 30:
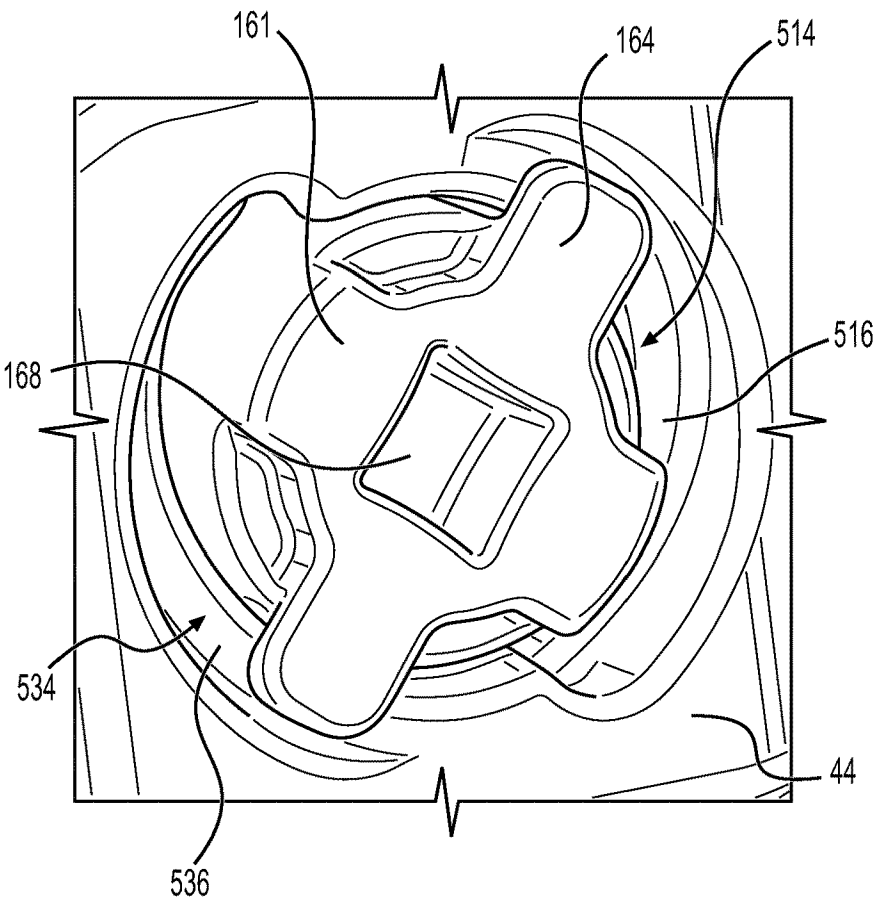
FIG. 30 is a magnified perspective view of the retainer in an unlocked position in the tip assembly of FIG. 29.
Figure 32:
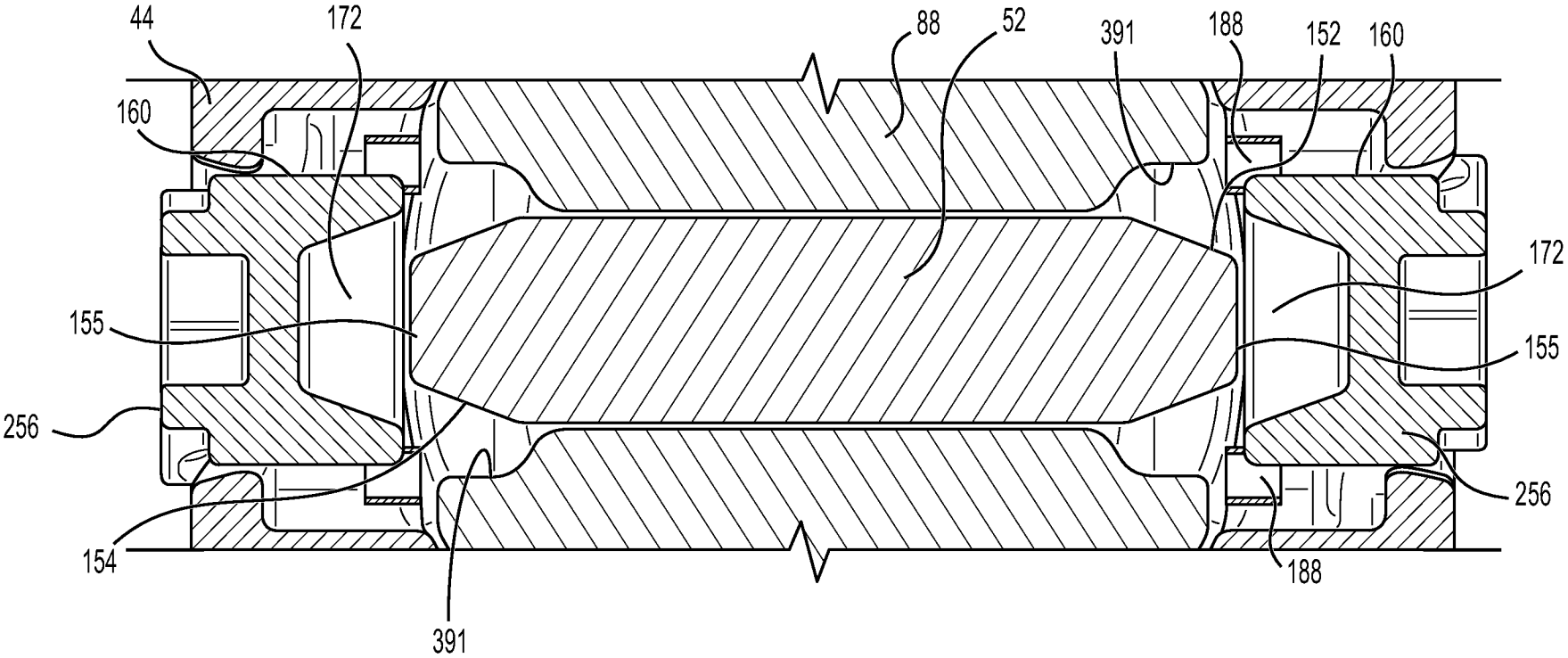
FIG. 32 is a vertical cross-sectional view taken along line C-C of the tip assembly of FIG. 29 showing the retainer in an unlocked position.

FIG. 30 illustrates a magnified perspective view of the retainer 256 of FIG. 29, in an unlocked position, with the retainer 256 disposed in a position at the entrance to the transverse hole 70 in the lateral side wall of the tip 44, and the tabs 164 of the retainer 256 positioned at the beginning of a helical ramp portion of the female threaded portion 514. As illustrated in FIG. 30, tabs 164 may engage with external surfaces 516 and 536 of ramps 514 and 534, respectively. FIG. 31 depicts a three dimensional rendering of retainer 256 installed within the transverse hole 70 of ground engaging tip 44. As illustrated in FIG. 31, bottom leg 180 of the spring clip 54 may be received in cutout 522 and flexible arms 184, 186 may engage with and grip outer surface 160 of retainer 56. As illustrated in FIG. 31, in this position of retainer 56, hooks 189 of detent portions 188 of the spring clip 54 or 254 may not be able to engage detent cutouts 166 on outer surface 160 of retainer 56. As a result, at least a portion of detent portions 188 (e.g., planar walls 191, see FIGS. 19, 20) may be received in cutouts 524 of transverse hole 70. FIG. 32 illustrates a cross-sectional view of the tip assembly taken along line C-C of FIG. 29. As illustrated in FIG. 32, in the unlocked position of retainer 256, axial cavity 172 of retainer 256 may be spaced apart from frustoconical lugs 152, 154 of pin 52. Furthermore, the detent portions 188 of the spring clip 54 may not be engaged with detent cutouts 166 (see FIGS. 15-18).

Figure 34:
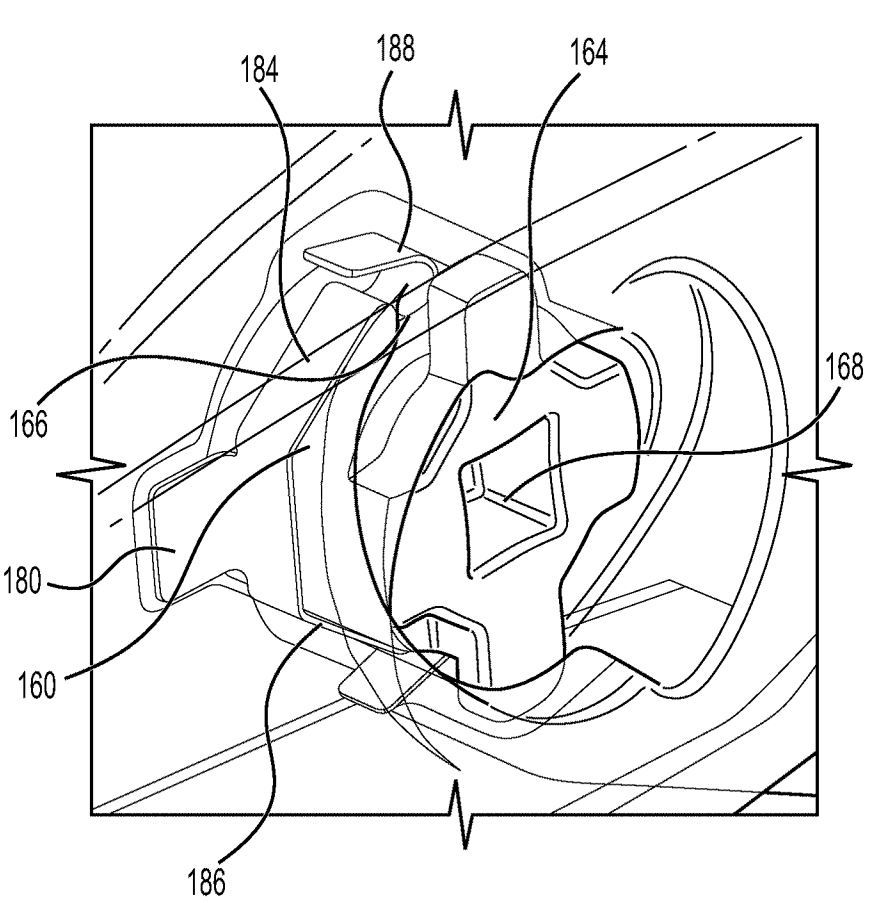
FIG. 34 depicts a three dimensional rendering of retainer in a locked position in the tip assembly of FIG. 29.
Figure 33:
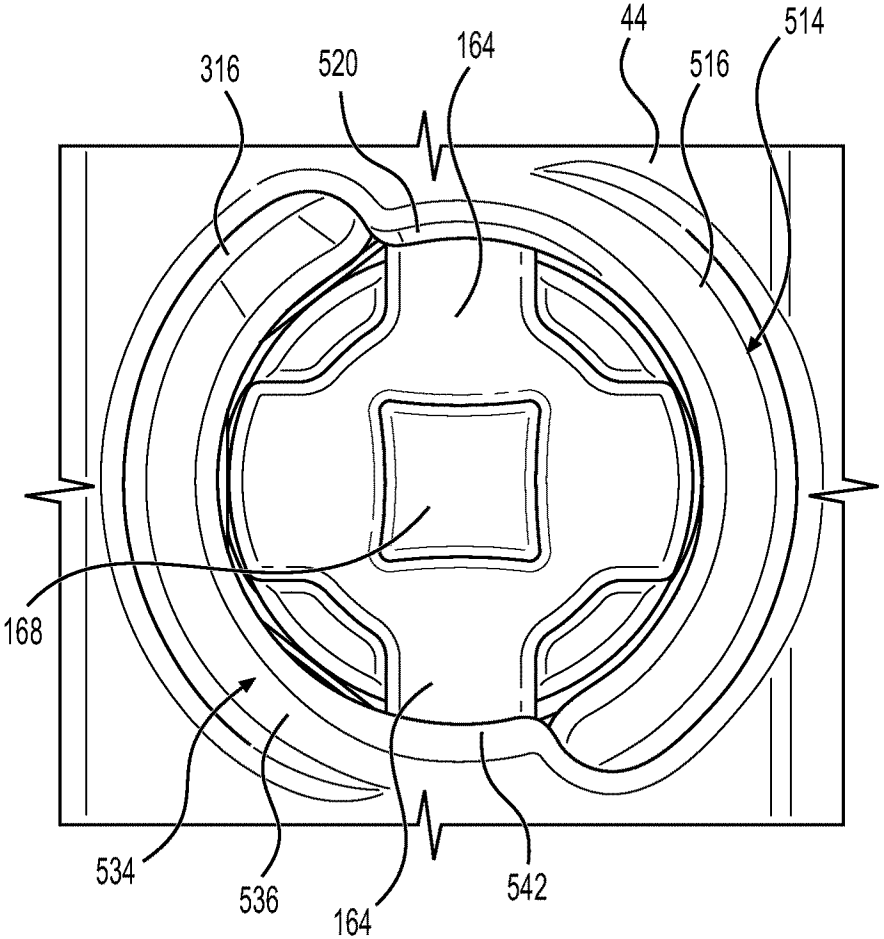
FIG. 33 is a magnified perspective view of the retainer in a locked position in the tip assembly of FIG. 29.
Figure 35:
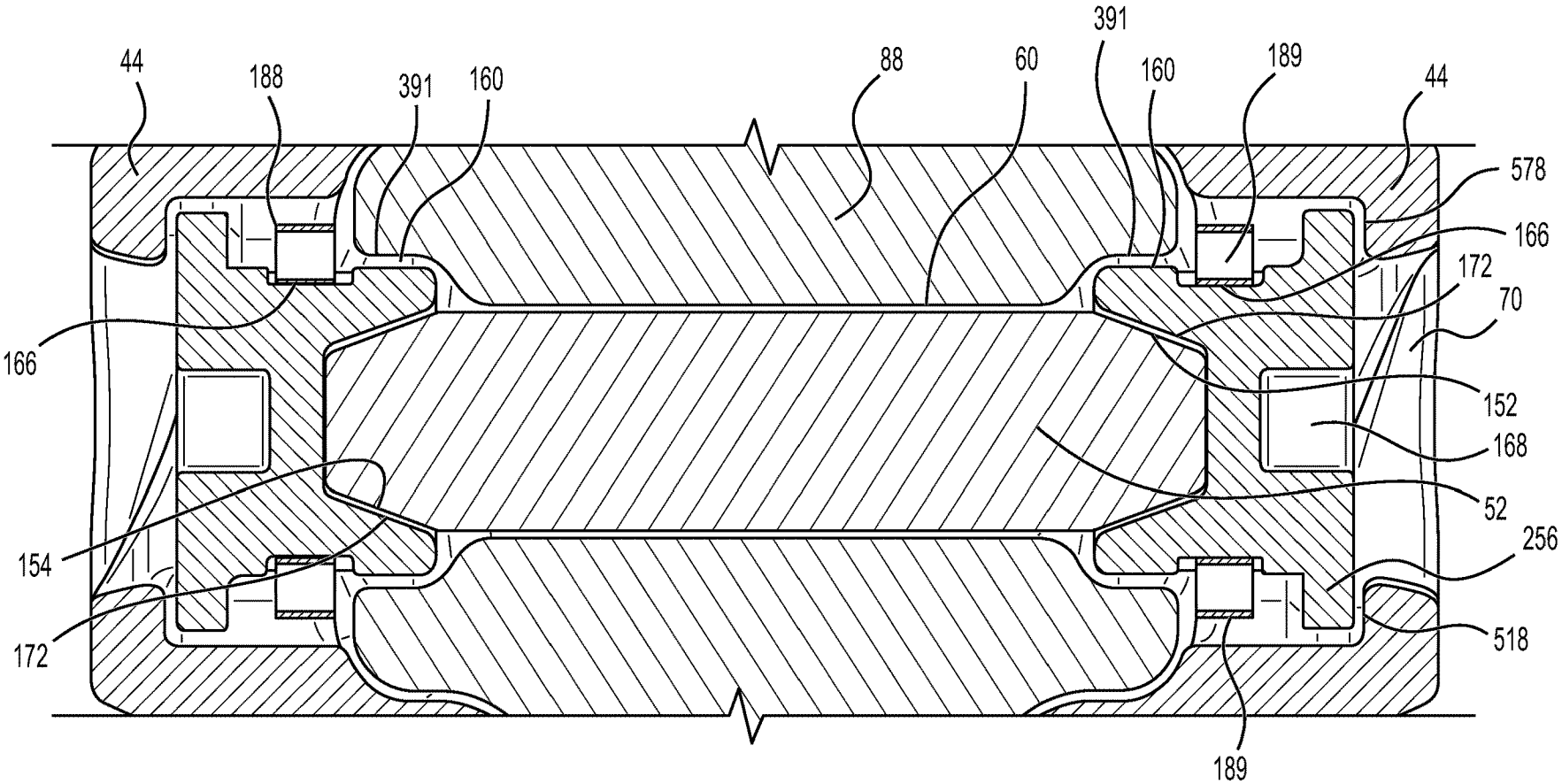
FIG. 35 is a vertical cross-sectional view taken along line C-C of the tip assembly of FIG. 29, showing the retainer in a locked position.

FIG. 33 illustrates a magnified perspective view of the retainer 256 in a locked position after the retainer 256 is rotated in a clockwise direction to engage the tabs 164, or in some alternative embodiments, at least a partial male thread feature formed around the outer peripheral wall of one end of the retainer, into the female threaded portion 514 of the transverse hole 70 in the lateral side wall of the tip 44. As further illustrated in FIG. 33, in the locked position, tabs 164 of retainer 256 may be disposed between ledges 520, 542 and external surfaces 516, 536, respectively, of ramps 514, 534, respectively. FIG. 34 depicts a three dimensional rendering of retainer 256 installed in a locked position within in transverse hole 70 of ground engaging tip 44. As illustrated in FIG. 34, bottom leg 180 of the spring clip 54 may be received in cutout 522 and flexible arms 184, 186 may engage with and grip outer surface 160 of retainer 256. As illustrated in FIG. 34, in the locked position of retainer 56, detent portions 188 of the spring clip 54 may engage with detent cutouts 166 on outer surface 160 of retainer 56. FIG. 35 illustrates a cross-sectional view of the tip assembly taken along line C-C of FIG. 29. As illustrated in FIG. 35, in the locked position of retainer 256, axial cavity 172 of retainer 56 may engage with the frustoconical lugs 152, 154 of pin 52. As also illustrated in FIG. 33, outer surface 160 of retainer 56, 156, or 256 may be spaced apart from inner side surface 391 of retainer pin opening 60. Furthermore, hooks 189 of the detent portions 188 of the spring clip 54 may engage with detent cutouts 166. The spring clip 54 may act as an anti-rotation mechanism that may resist rotation of the retainer 256. In this locked position as shown in FIGS. 33, 34, tabs 164 of the retainer 256 are located underneath the internal surfaces 518 of the female thread 514 (see FIG. 35), thus preventing the retainer 256 from being disengaged from the tip 44 and the nose 88 or 102 of the adapter 42. Removal of the retainer 256 from the tip 44 and adapter 42 to allow for replacement of a worn tip 44 may require counter-rotation of the retainer 256 by application of sufficient rotational torque to the retainer 256 to cause the hooks 189 of the detent portions 188 of the flexible arms 184, 186 of the spring clip 54 to be flexed radially outwardly until they come out of the detent cutouts 166 formed into the outer surface 160 of the retainer 256.

The combination of the pin 52 through the retainer pin opening 60 in the nose 88 or 102 of the adapter 42 and each retainer 256 disposed in a fully engaged position, may anchor the tip 44 on the adapter 42 and may provide shear strength against forces tending to separate the tip 44 from the adapter 42. In other words, as long as the retainer 256 is fully engaged in the transverse hole 70 of the tip 44 and prevented from rotating to come unthreaded from the fully engaged position by the spring clip 54, the cross-sectional area of the retainer 56 extending into the retainer pin opening 60 in the nose 88 or 102 of the adapter 42 along with the cross-sectional area of the frustoconical lugs 152, 154 of the pin 52 extending into the axial cavity 172 of the retainer 256 may provide shear strength against axial loads tending to separate the tip 44 from the adapter 42. It is contemplated that alternative embodiments may not include the pin 52, with just the retainer 56 in the fully engaged position providing the shear strength against forces tending to separate the tip 44 from the adapter 42.

Although the assembly of tip 44 with adapter 42 has been described above with reference to retainer 256 and spring clip 54, it is contemplated that similar assembly steps may be performed with any combination of retainers 56, 156, 256, and spring clips 54, 254. Alternative embodiments may only include the retainer 56, 156, 256 and the spring clip 54 on one of the opposite lateral sides of the tip assembly 20. Still other alternative embodiments may eliminate the pin 52 and may provide one or more of the retainers that are configured to pass through one or both of the transverse holes 70 through opposite lateral side walls of the tip 44 and extend into the aligned retainer pin opening 60 through the nose 88 or 102 of the adapter 42 when the nose 88 or 102 is fully seated within the nose cavity 440 extending in from the rear of the tip 44.

INDUSTRIAL APPLICABILITY

The disclosed tool retention system for ground engaging tools may be applicable to various earth-working machines, such as, for example, excavators, wheel loaders, hydraulic mining shovels, cable shovels, bucket wheels, bulldozers, and draglines. When installed, the disclosed configurations of an exemplary retainer system and components may provide secure and reliable attachment and detachment of ground engaging tools to and from various earth-working implements. In particular, certain configurations of the disclosed retainer systems may increase the strength of the retainer system against forces that may cause separation of the tip (e.g., wear component) from the adapter, improve the manufacturability of the various components, and simplify installation and removal of a tip from the adapter.

One exemplary implementation of this disclosure includes a method for removably attaching a ground engaging tip 44 to an adapter 42 fixed to an earth-working implement (e.g., 10 or 30) of an earth-working machine. The adapter 42 may include a retainer pin opening 60 extending into the nose 88 or 102 of the adapter 42 in a direction transverse to a longitudinal axis 201 of the adapter 42. The retainer pin opening 60 may have a circular or a non-circular cross-section, and may extend all the way through the nose 88 or 102 of the adapter 42 from one lateral side of the nose to the opposite lateral side of the nose. Each of the opposite ends of the retainer pin opening 60 may include a larger diameter counterbore configured to receive one axial end of the retainer 56, 156, 256 when the nose 88 or 102 is fully installed into the nose cavity 440 extending into the back side of the tip 44, and the retainer is fully engaged into the transverse hole 70 through the lateral wall of the tip 44 with the one axial end of the retainer protruding into the retainer pin opening 60 of the adapter 42. The lugs 152, 154 of the pin 52 disposed in the retainer pin opening 60 may be seated in the axial cavities 172 extending into the one axial end of the retainer when the retainer is fully engaged into the locked position shown in FIG. 35.

Engagement of the retainer into the transverse hole 70 through the lateral wall of the tip 44 may include engaging the one or more tabs 164 extending radially outwardly from an outer circumferential surface 160 at a first end 157 of the retainer body 158 with the female thread 514 and/or 534 (see FIGS. 21, 24, 25, 30) formed along an inner circumferential wall 512 of the transverse hole 70 through each of the opposite lateral side walls 452, 454 of the tip 44. In some alternative embodiments, the one or more tabs 164 may be replaced by at least a partial male thread formed around an outer peripheral surface at the first end of the retainer, with the male thread being configured to threadedly engage with the female threaded portion 514 and/or 534 along the inner circumferential wall of the outer opening portion of the transverse hole 70 in a lateral side wall of the tip 44.

Rotation of the retainer 56, 156, 256 into a locked position (shown in FIG. 35) includes rotating the retainer until the second, substantially cylindrical opposite end of the retainer has entered the retainer pin opening 60 in the nose 88 or 102 of the adapter 42. The retainer may be rotated until the lugs 152, 154 of the pin 52 disposed in the retainer pin opening 60 are fully seated in the axial cavities 172 extending into the second axial end of each of the retainers 56, 156, 256 when the retainers 56, 156, 256 are fully engaged into their locked positions, as shown in FIG. 35.

When the retainer is rotated until reaching the fully locked position, with the lugs 152, 154 of the pin 52 fully seated in the axial cavities 172 of each of the retainers, the two flexible arms 184, 186 of the spring clip 54, 254 protruding upwardly and outwardly from the base portion 182 of the spring clip 54, 254 extend into the transverse hole 70 from the inner extent of the transverse hole and tightly grip an outer circumferential surface 160 of the retainer 56, 156, 256 when the retainer is fully engaged into the transverse hole 70. As shown in FIGS. 19 and 20, each of the flexible arms 184, 186 of the spring clip 54, 254 terminates at a distal end in a detent portion 188 configured to engage with a detent cutout 166 formed into the outer circumferential surface 160 of the retainer 56, 156, 256 when the retainer has been fully engaged into the transverse hole 70, thus acting as an anti-rotation mechanism resisting the rotation of the retainer. A square drive tool may be fitted into a socket 168 at the first axial end 157 of the retainer 56, 156, 256, to rotate the retainer 56, 156, 256 in a clockwise or counterclockwise direction. Rotation of the retainer 56, 156, 256 in a clockwise direction may move the retainer into a locked position, as shown in FIG. 35, and rotation of the retainer in a counterclockwise direction may move the retainer to an unlocked position, as shown in FIG. 32, at which point the retainer may be removed from the nose 88 or 102 of the adapter 42 and from the tip 44 to allow for removal of the tip 44 from the adapter 42. The spring clip 54, 254 may be configured to provide sufficient resistance to counter-rotation of the retainer through the spring clip pressure of the detent portions 188 at the distal ends of the flexible arms 184, 186 in the detent cutouts 166 formed into the outer circumferential surface 160 of the retainer 56, 156, 256, and the spring clip pressure of the flexible arms 184, 186 against the outer circumferential surface 160 of the retainer 56, 156, 256, such that the retainer 56, 156, 256 may not come unthreaded during normal machine operations. Nonetheless, the spring clip 54, 254 with detent portions 188 seated in the detent cutouts 166 on the outer circumferential surface 160 of the retainer 56, 156, 256 may be disengaged from the detent cutouts 166 to allow for counter-rotation of the retainer to remove the retainer and allow for replacement of the tip 44 when an operator provides sufficient torque in a counter-clockwise direction to the retainer 56, 156, 256, e.g., using a drive tool that mates with the retainer socket 168 in one axial end of the retainer.

It will be apparent to those skilled in the art that various modifications and variations can be made to the disclosed retainer system. Other embodiments will be apparent to those skilled in the art from consideration of the specification and practice of the disclosed method and apparatus. It is intended that the specification and examples be considered as exemplary only, with a true scope being indicated by the following claims and their equivalents.

What is claimed is:

1. A retention mechanism for connecting a ground engaging tip to an adapter, the retention mechanism comprising:
- a pin configured to be inserted into a retainer pin opening in the adapter;
- a spring clip configured to be inserted into the tip through a first end of a transverse hole in the tip; and
- a retainer configured for insertion through a second end of the transverse hole, the retainer comprising:
  - a retainer body extending from a first axial end to a second axial end;
  - at least one tab extending radially from the retainer body at the first axial end, the at least one tab being configured to engage with a female thread in the transverse hole;
  - at least one detent cutout disposed on an outer surface of the retainer body and configured to receive a portion of the spring clip; and
  - an axial cavity at the second axial end configured to receive one end of the pin.

2. The retention mechanism of claim 1, wherein the at least one tab includes a pair of tabs extending radially from the retainer body in opposite directions.

3. The retention mechanism of claim 1, wherein the pin includes:
- an elongated shank;
- a first frustoconical lug extending from one end of the elongated shank; and
- a second frustoconical lug extending from an opposite end of the elongated shank.

4. The retention mechanism of claim 3, wherein the elongated shank of the pin has a non-cylindrical cross-section.

5. The retention mechanism of claim 1, wherein at least a portion of the pin has a cylindrical cross-section.

6. The retention mechanism of claim 1, wherein the axial cavity of the retainer is tapered.

7. The retention mechanism of claim 1, wherein the spring clip includes:
- at least one leg;
- a base portion extending perpendicularly from one edge of the at least one leg;
- a pair of flexible arms extending from opposite ends of the base portion and configured to engage with the outer surface of the retainer body; and
- a detent portion attached to a distal end of each of the flexible arms.

8. The retention mechanism of claim 7, wherein the detent portion is configured to engage with the at least one detent cutout of the retainer body.

9. The retention mechanism of claim 7, wherein each of the flexible arms is inclined at an obtuse angle relative to the base portion.

10. The retention mechanism of claim 1, wherein the female thread includes an external surface extending circumferentially from an external surface of the tip.

11. The retention mechanism of claim 10, wherein the female thread extends circumferentially over an angle ranging between 90 degrees and 360 degrees.

12. The retention mechanism of claim 1, wherein
- the retainer is a first retainer, and
- the retention mechanism includes a second retainer configured to receive an opposite end of the pin.

13. The retention mechanism of claim 12, wherein
- the transverse hole is first transverse hole,
- the tip includes a second transverse hole,
- the spring clip is a first spring clip, and
- the retention mechanism includes:
  - a second spring clip configured to be inserted into the tip through a first end of the second transverse hole, and
  - the second retainer configured to be inserted into the tip through a second end of the second transverse hole.

14. A tip assembly, comprising:
- an adapter configured to be attached to a work implement, the adapter including:
  - a nose; and
  - a retainer pin opening extending through the nose;
- a ground engaging tip configured to be attached to the nose, the tip including:
  - a nose cavity configured to receive the nose, the nose cavity defining a pair of side walls spaced apart from each other;
  - a first transverse hole disposed in a first one of the side walls; and
  - a second transverse hole disposed in a second one of the side walls; and
- a retention mechanism, including:
  - a pin configured to be inserted into the retainer pin opening in the nose;
  - a first spring clip configured to be inserted into the first transverse hole;
  - a second spring clip configured to be inserted into the second transverse hole;
  - a first retainer configured for insertion into the first transverse hole, the first retainer configured to engage with the pin; and
  - a second retainer configured for insertion into the second transverse hole, the second retainer configured to engage with the pin;
  - wherein each of the first retainer and the second retainer includes a retainer body extending from a first axial end to a second axial end and at least one tab extending radially from the retainer body at the first axial end, the at least one tab being configured to engage with a thread in a respective one of the first transverse hole or the second transverse hole.

15. The tip assembly of claim 14, wherein the pin includes:

an elongated shank;

a first frustoconical lug extending from one end of the elongated shank; and a second frustoconical lug extending from an opposite end of the elongated shank.

16. The tip assembly of claim 15, wherein each of the first retainer and the second retainer includes:

at least one detent cutout disposed on an outer surface of the retainer body and configured to receive a portion of a respective one of the first spring clip or the second spring clip; and an axial cavity at the second axial end configured to receive a respective one of the first frustoconical lug or the second frustoconical lug of the pin.

17. The tip assembly of claim 16, wherein the elongated shank of the pin has a non-cylindrical cross-section; and the retainer pin opening in the nose has a non-cylindrical cross-section configured to receive the elongated shank of the pin.

18. The tip assembly of claim 16, wherein each of the first spring clip and the second spring clip includes:

at least one leg;

a base portion extending perpendicularly from one edge of the at least one leg;

a pair of flexible arms extending from opposite ends of the base portion and configured to engage with the outer surface of the retainer body; and a detent portion attached to a distal end of each of the flexible arms; and an inner surface of the nose cavity includes a cutout configured to receive the at least one leg of a respective one of the first spring clip or the second spring clip.

19. A retention mechanism, comprising:

a pin;

a retainer, including:

a retainer body extending from a first axial end to a second axial end;

at least one tab extending radially from the retainer body at the first axial end;

at least one detent cutout disposed on an outer surface of the retainer body; and an axial cavity at the second axial end configured to receive one end of the pin; and a spring clip, including:

at least one leg;

a base portion extending perpendicularly from one edge of the at least one leg;

a pair of flexible arms extending from opposite ends of the base portion and configured to engage with the outer surface of the retainer body; and a detent portion attached to a distal end of each of the flexible arms, wherein the detent portion is configured to engage with the at least one detent cutout of the retainer;

wherein the at least one leg is configured to extend radially outward from the base portion.

20. The retention mechanism of claim 19, wherein the at least one leg of the spring clip is a bottom leg, and the spring clip includes a top leg extending from the base portion and spaced apart from the bottom leg, wherein the top leg and the bottom leg extend from opposite edges of the base portion.

* * * * *